US012668970B1

(12) United States Patent
Rivas et al.

(10) Patent No.: US 12,668,970 B1
(45) Date of Patent: Jun. 30, 2026

(54) PANELIZED STRUCTURAL WALL, FLOOR, AND ROOF PANEL

(71) Applicant: Cover Technologies, Inc., Gardena, CA (US)

(72) Inventors: Alexis Xavier Rivas, Gardena, CA (US); Craig Derian, Gardena, CA (US)

(73) Assignee: Cover Technologies, Inc., Gardena, CA (US)

( * ) Notice: Subject to any disclaimer, the term of this patent is extended or adjusted under 35 U.S.C. 154(b) by 266 days.

(21) Appl. No.: 18/630,882

(22) Filed: Apr. 9, 2024

Related U.S. Application Data

(63) Continuation-in-part of application No. 18/433,312, filed on Feb. 5, 2024.

(60) Provisional application No. 63/443,247, filed on Feb. 3, 2023, provisional application No. 63/443,240, filed on Feb. 3, 2023, provisional application No. 63/443,251, filed on Feb. 3, 2023.

(51) Int. Cl.

| | |
|---|---|
| ***E04C 2/52*** | (2006.01) |
| ***E04B 2/58*** | (2006.01) |
| ***E04B 5/10*** | (2006.01) |
| ***E04B 5/48*** | (2006.01) |
| ***E04B 7/22*** | (2006.01) |
| *E04B 1/62* | (2006.01) |
| *E04B 1/80* | (2006.01) |

(52) U.S. Cl.
CPC ..... *E04B 5/10* (2013.01); *E04B 2/58* (2013.01); *E04B 5/48* (2013.01); *E04B 7/22* (2013.01); *E04B 1/625* (2013.01); *E04B 1/80* (2013.01)

(58) Field of Classification Search
CPC ..... E04B 5/10; E04B 2/58; E04B 7/22
USPC ..... 52/293.3, 299, 220.2
See application file for complete search history.

(56) References Cited

U.S. PATENT DOCUMENTS 2,109,655 A * 3/1938 Sylvan ..... E04B 1/24 52/579
2,610,710 A * 9/1952 Shannon ..... E04B 1/0007 52/298
2,948,364 A * 8/1960 Cooper ..... E04B 2/60 52/579
3,002,591 A * 10/1961 Hess ..... E04D 3/366 52/584.1
3,012,639 A * 12/1961 Pavlecka ..... E04B 5/10 52/275
3,083,794 A * 4/1963 Stovall, Jr. ..... B21D 39/034 29/21.1

(Continued)

*Primary Examiner* — Basil S Katcheves
(74) *Attorney, Agent, or Firm* — Run8 Patent Group, LLC; Peter Miller

(57) ABSTRACT

The panel system includes a roof panel including: an inner panel defining an inner panel edge to rest on a top plate of first wall panel; an insulation layer extending above the inner panel; a moisture barrier arranged above the insulation layer and extending across an exterior surface of the roof panel; a first joist coupled to and extending below the inner panel and offset from a first edge of the inner panel; a second joist coupled to and extending below the inner panel, laterally offset from the first joist; a flange coupled to the inner panel, extending upwardly from the second edge of the inner panel, and configured to fasten to a second roof panel; and a gutter mount extending outwardly from the first edge of the roof panel and locating a gutter over the top plate of the wall panel.

20 Claims, 13 Drawing Sheets

(56) References Cited

U.S. PATENT DOCUMENTS

| | | | | | |
|---|---|---|---|---|---|
| 3,417,537 | A * | 12/1968 | Wilson | E04C 3/32 | 52/843 |
| 3,521,417 | A * | 7/1970 | Onjukka | E04B 2/60 | 52/282.4 |
| 3,585,768 | A * | 6/1971 | Klein | E04B 2/7818 | 52/282.4 |
| 3,601,942 | A * | 8/1971 | Wilson | E04B 1/18 | 52/316 |
| 3,638,370 | A * | 2/1972 | Miller | E04B 2/62 | 52/36.6 |
| 3,683,580 | A * | 8/1972 | McManus | E04B 5/29 | 52/336 |
| 3,716,027 | A * | 2/1973 | Vickstrom et al. | E04B 5/10 | 52/669 |
| 3,759,006 | A * | 9/1973 | Tamboise | E04B 5/10 | 52/406.1 |
| 4,056,908 | A * | 11/1977 | McManus | E04B 5/40 | 52/694 |
| 2004/0065032 | A1* | 4/2004 | Commins | E04C 3/12 | 52/223.14 |
| 2008/0127584 | A1* | 6/2008 | Schiffmann | B32B 5/28 | 52/293.3 |
| 2008/0307747 | A1* | 12/2008 | Douglas | E04B 1/12 | 52/745.13 |
| 2024/0175230 | A1* | 5/2024 | Marshall, III | E02D 31/004 | |
| 2025/0207390 | A1* | 6/2025 | Woodland | E04B 2/8641 | |

* cited by examiner

PANELIZED STRUCTURAL WALL, FLOOR, AND ROOF PANEL

CROSS-REFERENCE TO RELATED APPLICATIONS

This application is a continuation-in-part of U.S. patent application Ser. No. 18/433,312, filed on 5 Feb. 2024 which claims priority to U.S. Provisional Application No. 63/443,240, filed on 3 Feb. 2023, U.S. Provisional Application No. 63/443,251, filed on 3 Feb. 2023, and U.S. Provisional Application No. 63/443,247, filed on 3 Feb. 2023, all of which are incorporated in their entirety by this reference.

This Application is a related to U.S. application Ser. No. 16/875,079, filed on 15 May 2020, Ser. No. 17/121,530, filed on 14 Dec. 2020, and Ser. No. 18/225,402, filed on 24 Jul. 2023, each of which is incorporated in its entirety by this reference.

TECHNICAL FIELD

This invention relates generally to the field of prefabricated structures and more specifically to a new and useful panelized structural wall and roof panels in the field of prefabricated structures.

DESCRIPTION OF THE EMBODIMENTS

Figure 1:
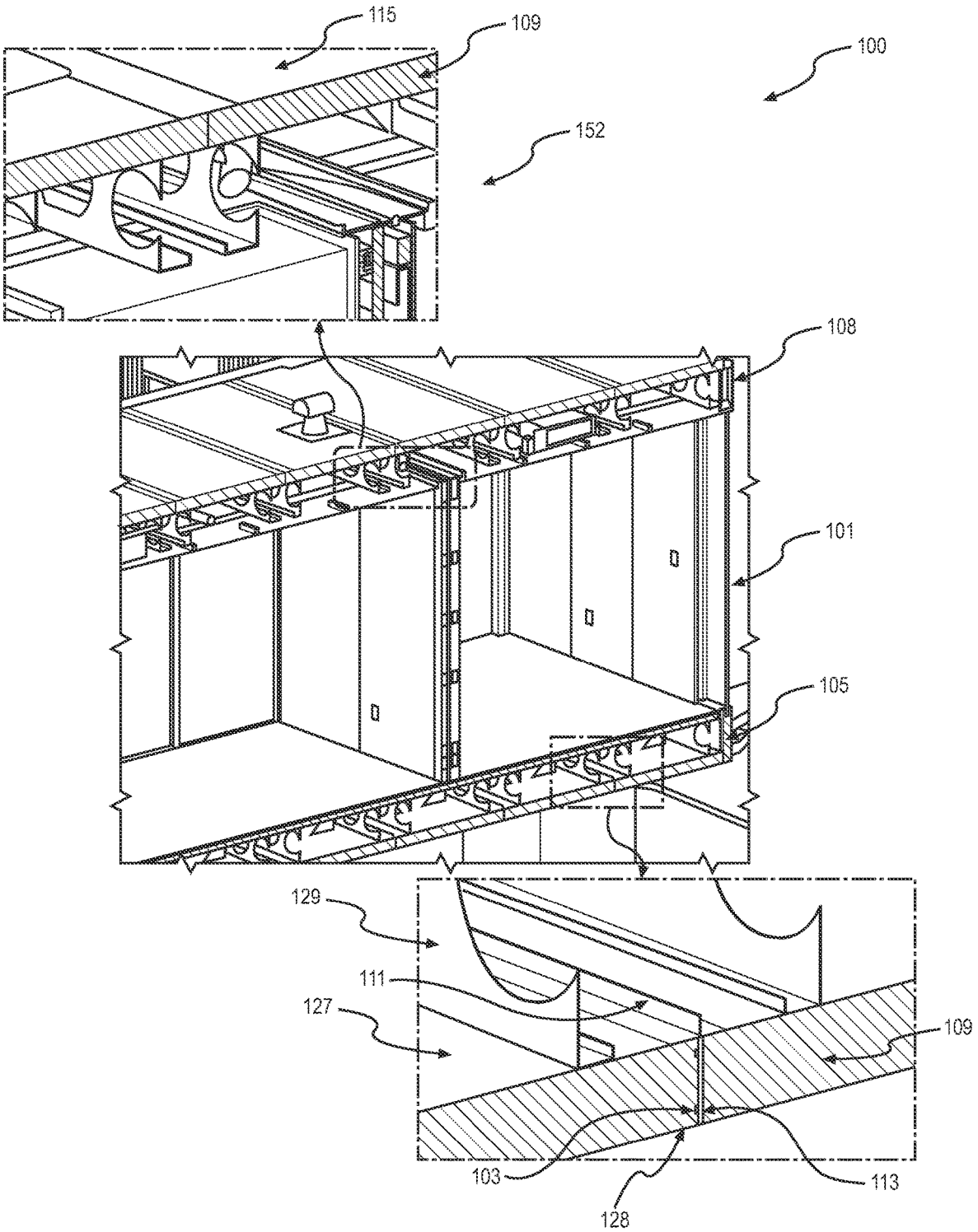
FIG. 1 is a representation of one variation of the panel system.

The following description of embodiments of the invention is not intended to limit the invention to these embodiments but rather to enable a person skilled in the art to make and use this invention. Variations, configurations, implementations, example implementations, and examples described herein are optional and are not exclusive to the variations, configurations, implementations, example implementations, and examples they describe. The invention described herein can include any and all permutations of these variations, configurations, implementations, example implementations, and examples.

1. Wall Panel

As shown in FIGS. 1, 3, 4, and 9, a panel system 100 includes a first wall panel 101 including: a left column element 102; a right column element 104; a footer element; a header element; an insulative element; a left flange; and a left return flange 114.

The left column element 102 of the wall panel: is configured to carry vertical loads through a left side of the wall panel; and defines a left gasket relief 103 extending vertically along the left column element 102. The right column element 104 is configured to carry vertical loads through a right side of the wall panel.

The footer element: extends between the left column element 102 and the right column element 104; and defines a lower vertical wall datum 106 configured to seat on a vertical floor datum 107 of a floor panel 126 to vertically locate the wall panel 101 relative to the floor panel 126.

The header element 108 extends between the left column element 102 and the right column element 104 above the footer element.

The insulative element 109 extends between the left column element 102, the right column element 104, the header element, and the footer element.

The left flange: extends rearward from the left column element 102; is laterally offset from the left gasket 113 relief; is configured to mate to a second right flange 117 of a second wall panel 101 installed adjacent the wall panel, via a series of clinch connections; and defines a left lateral wall datum 112 configured to laterally locate the first wall panel 101 relative to the second wall panel.

The left return 114 flange: is configured to stiffen the left flange; and extends laterally from the left flange 110 opposite the second wall panel.

The panel system 100 also includes a gasket 113: located along the left gasket 113 relief; and configured to compress between the left gasket relief 103 of the first wall panel 101 and a second right column element 104 of a second wall panel 101 during installation of the left series of clinch connections.

1.1 Variation: Exterior Façade Panel

Figure 6:
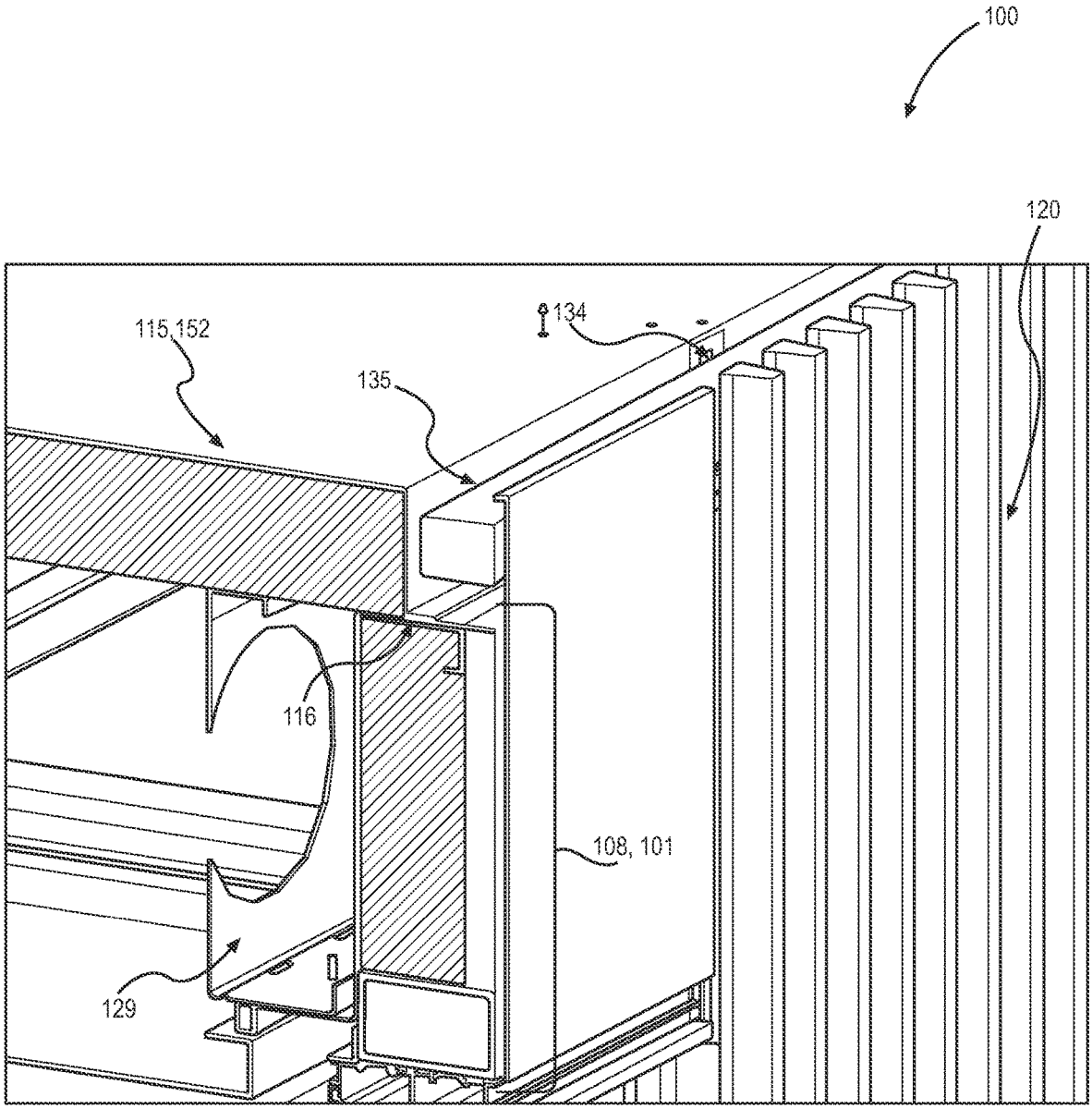
FIG. 6 is a representation of one variation of the panel system.
Figure 9:
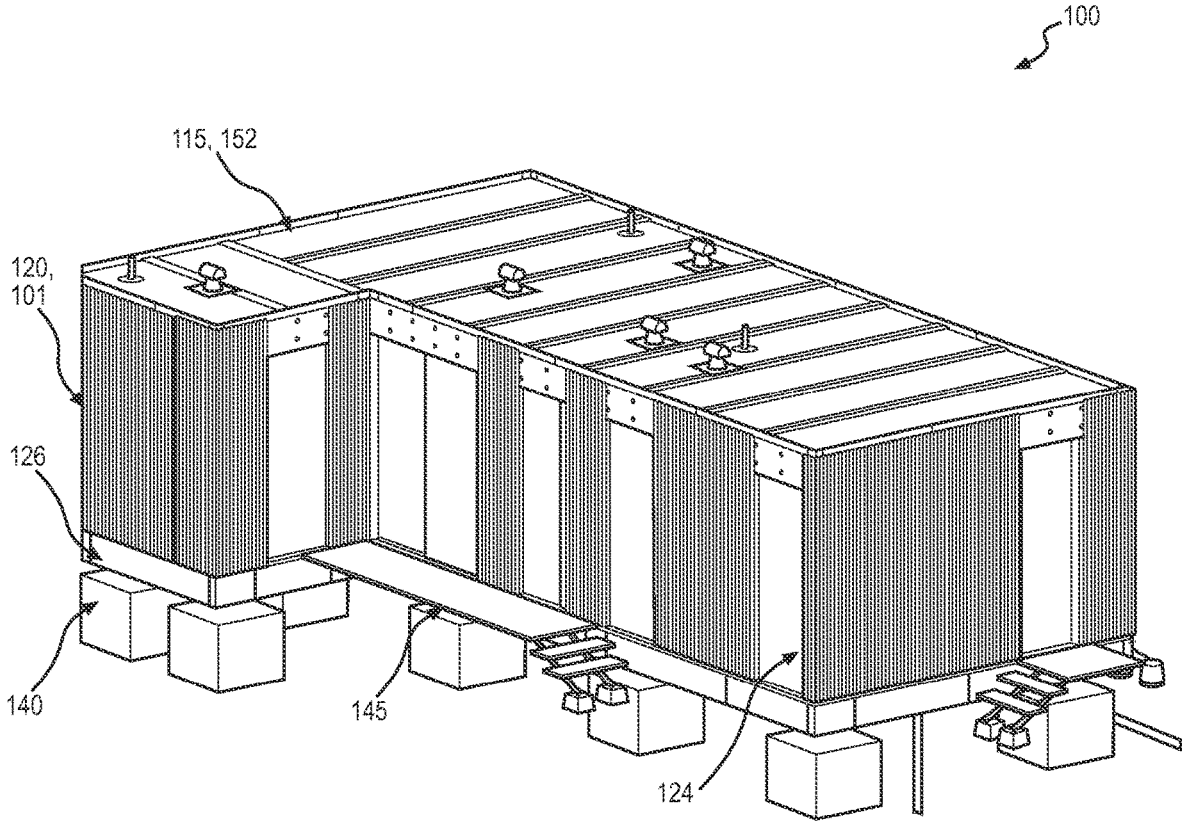
FIG. 9 is a representation of one variation of the panel system.

In one variation, shown in FIGS. 6 and 9, the panel system 100 includes an exterior façade panel 120. The wall panel 101 includes: a left column element 102; a right column element 104; a lower vertical wall datum 106; a header element; an insulative element; an exterior façade panel 120; and a left flange.

The left column element 102: is configured to carry vertical loads through a left side of the wall panel; and defines a left gasket relief 103 extending vertically along the left column element 102.

The right column element 104 is configured to carry vertical loads through a right side of the wall panel.

The lower vertical wall datum 106 is configured to seat on a vertical floor datum 107 surface of a floor panel 126 to vertically locate the wall panel 101 relative to the floor panel 126.

The header element 108 extends between the left column element 102 and the right column element 104 above the footer element.

The insulative element: extends between the left column element 102, the right column element 104, the header element, and the footer element.

The exterior façade panel 120: defines a prefinished exterior surface; and extends across outer faces of the left column element 102, the right column element 104, the footer element, and the header element.

The left flange: extends rearward from the left column element 102 opposite the exterior façade panel 120; is laterally offset from the left gasket 113 relief; is configured to mate to a second right flange 117 of a second wall panel 101 installed adjacent the wall panel, via a series of clinch connections; and defines a left lateral wall datum 112 configured to laterally locate the first wall panel 101 relative to the second wall panel.

The gasket 113 is: located along the left gasket 113 relief; and configured to compress between the left gasket relief 103 of the first wall panel 101 and a second right column element 104 of a second wall panel 101 during installation of the left series of clinch connections.

1.2 Variation: Interior Façade Panel

Figure 3:
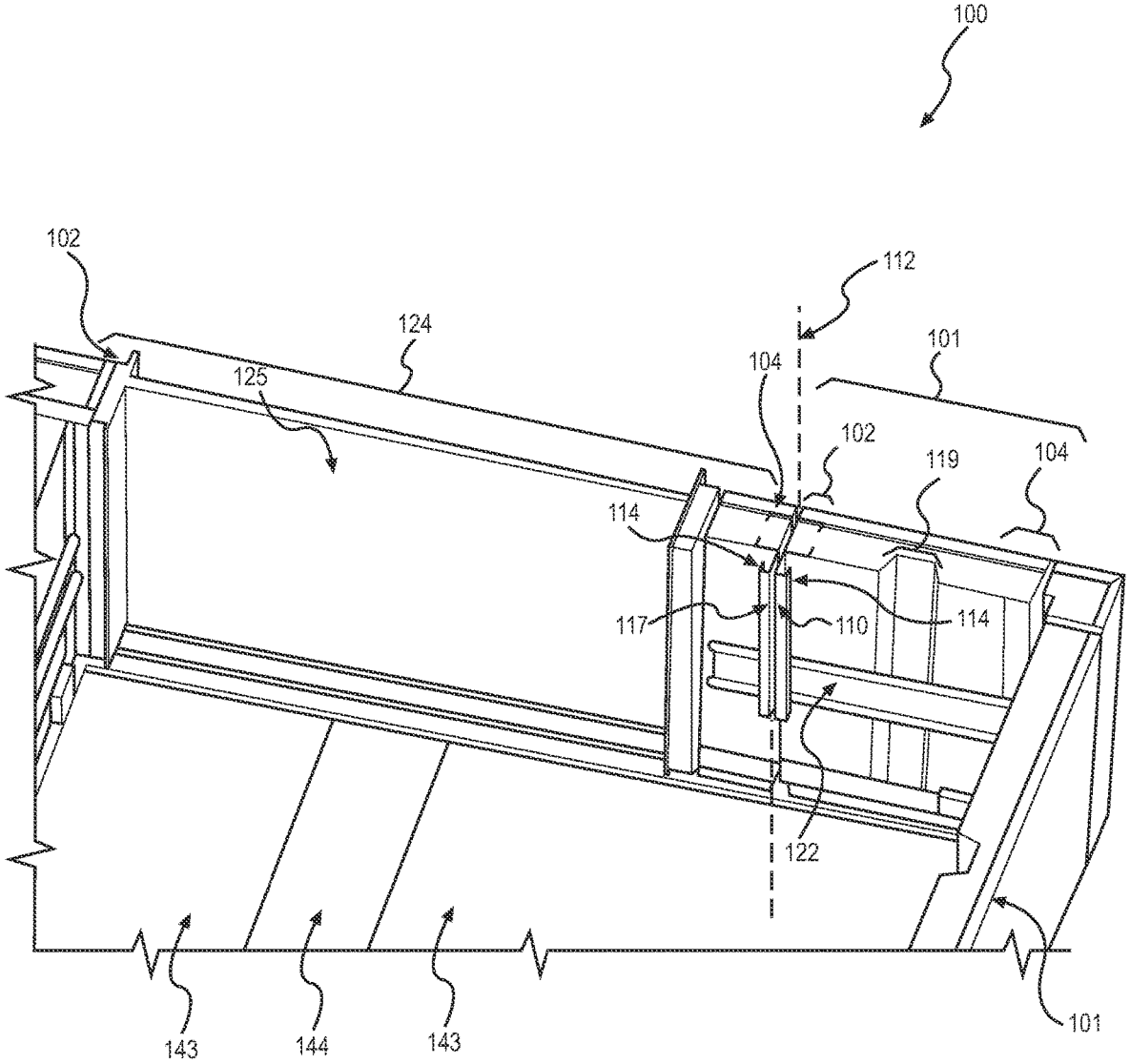
FIG. 3 is a representation of one variation of the panel system.
Figure 4:
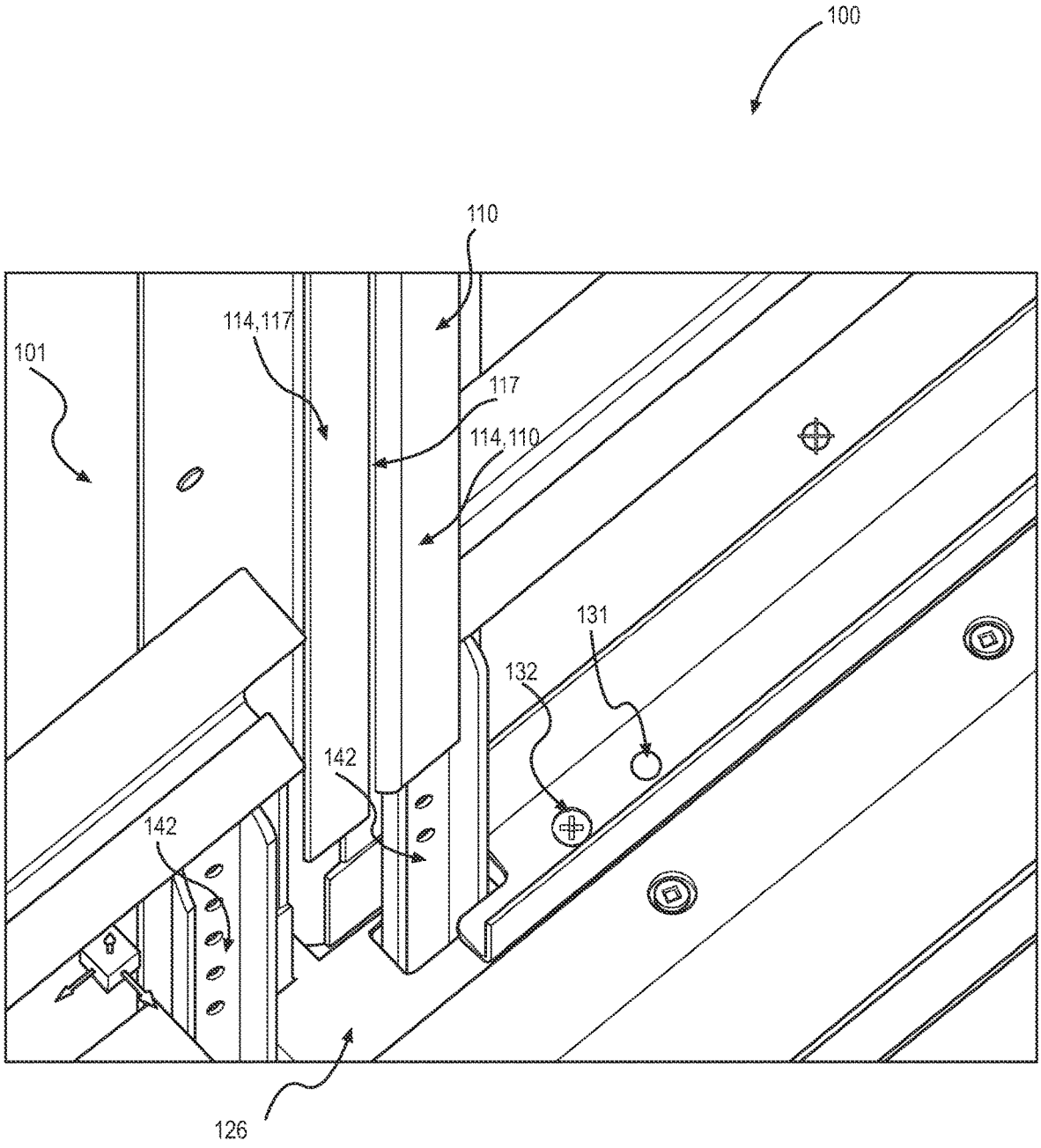
FIG. 4 is a representation of one variation of the panel system.

In one variation, shown in FIG. 3, the panel system 100 includes: a wall panel 101 defining an interior façade hanger 122; and an interior façade panel.

The first wall panel 101 includes: a left column element 102; a right column element 104; a lower vertical wall datum 106; a header element; an insulative element; an exterior façade mount 121; a left flange; and an interior façade hanger 122.

The left column element 102: is configured to carry vertical loads through a left side of the wall panel; and defines a left gasket relief 103 extending vertically along the left column element 102.

The right column element 104 is configured to carry vertical loads through a right side of the wall panel.

The lower vertical wall datum 106 is configured to seat on a vertical floor datum 107 surface of a floor panel 126 to vertically locate the wall panel 101 relative to the floor panel 126.

The header element 108 extends between the left column element 102 and the right column element 104 above the footer element.

The insulative element 109 extends between the left column element 102, the right column element 104, the header element, and the footer element.

The left flange: extends rearward from the left column element 102 opposite the exterior façade panel 120; is laterally offset from the left gasket 113 relief; is configured to mate to a second right flange 117 of a second wall panel 101 installed adjacent the wall panel, via a series of clinch connections; and defines a left lateral wall datum 112 configured to laterally locate the first wall panel 101 relative to the second wall panel.

The exterior façade mount 121 extends between the left column element 102 and the right column element 104 along an exterior surface of the first wall panel.

The interior façade hanger 122 defines a track along an interior surface of the first wall panel.

The panel system 100 further includes: an interior finish panel configured to install onto the interior façade hanger 122 of the first wall panel 101 including a prefinished interior surface; and an exterior façade panel 120 configured to install onto the exterior façade mount 121 of the first wall panel 101 and defining a prefinished exterior surface.

2. Applications

Generally, the wall panel 101 defines a prefabricated unitized structural wall within a panelized structural building system. In particular, a set of similar or identical wall panels 101, similar or identical floor panels 126, and similar or identical roof panels 152 can be fabricated offsite with precision tooling and later assembled (e.g., for the first time) at a building site to form a complete, habitable building (e.g., a house, a pool house, a cabin, a multi-family residential apartment, a carriage house) with minimal or no onsite customization (e.g., or on-site trimming or modification) of these panels and with minimal or no onsite waste.

In particular, a wall panel 101 in the panelized structural building system includes header, footer, and left and right column elements 104 that function as primary vertical load-carrying elements of the wall and are assembled with relatively low precision. The wall panel 101 also includes left and right J-flanges (e.g., flanges and returns) that extend outwardly from the left and right column elements 104 to define high-precision lateral wall datums 112, to define the maximum width of the wall panel, and to form interfaces for rigid clinch connections 111 to adjacent wall panels 101. The wall panel 101 further includes upper and lower inner flanges that extend rearward from the header and footer panels to define high-precision vertical wall datums, to define the maximum height of the wall panel, and to form interfaces for rigid clinch or threaded-fastener 132 connections to adjacent roof and floor panels 126. The wall panel 101 further includes a foam (or other castable insulative shear material) insulative element 109 cast within voids of the structural elements of the wall panel 101 to affix the prefinished exterior façade film or sheet to the structural elements, bond all structural elements, and increase shear and vertical load-carrying capacity of the wall panel.

For example, the wall panel 101 can include a set of folded sheet metal flanges that: define the lateral and vertical bounds of the wall panel; define datums for accurate and repeatable location of the wall panel 101 relative to other wall panels 101, floor panels 126, and roof panels 152; define connecting surfaces for fastening the wall panel 101 to adjacent wall panels 101, floor panels 126, and roof panels 152; and distribute vertical and shear load between these adjacent wall panels 101, floor panels 126, and roof panels 152. More specifically, the wall panel 101 can include the high-precision folded sheet metal connection flanges: dimensionally and geometrically referenced to the prefinished exterior façade and arranged about the perimeter of a lower-precision assembly of folded sheet metal structural elements bonded and retained by cast-in-place structural foam insulative elements.

The wall panel 101 can therefore be accurately and repeatably (i.e., precisely) installed on a floor structure defining corresponding vertical floor datums and between wall panels 101 that define corresponding lateral wall datums 112. The wall panel 101 can also accurately and repeatably locate the roof panels 152—that define corresponding vertical roof datums—overhead.

For example, a wall panel 101 can be fabricated in a high-precision jig by locating a prefinished exterior façade film or sheet in the base of the jig and then locating these connection flanges along edges of a rectangular jig with datum features (e.g., planar surfaces) defined by these connection flanges constrained against corresponding features in the jig. Structural elements (e.g., sheet metal studs, structural foam, header panels, foot panels) can then be fastened, bonded, or welded to these connection flanges, and expanding structural foam can then be injected around and between these structural elements to complete the structural features of the wall panel. Because the jig defines a maximal geometry of the wall panel, because connection flanges in the wall panel 101 are assembled onto datum reference surfaces in the jig, and because remaining structural elements are assembled inside of the envelope of these connection flanges, dimensions of the completed wall panel 101—as measured at maximal features of this wall panel 101—may fall within a very tight tolerance, such as +0.000"/−0.020" for a 48"-wide, 100"-tall nominal dimension of the wall panel 101 at a standard production temperature of 72° F.

Therefore, the flanges—defining datums for accurately and repeatably locating the wall panel 101 relative to adjacent wall panels 101, a floor panel 126 below, and a roof panel 152 above—can be fixed within a tight tolerance on nominal dimension, planarity, straightness, and/or flatness, etc. within the jig. Separate structural (i.e., load-carrying) elements can then be assembled around these connection flanges to carry vertical and shear loads between these connection flanges, and an insulative element 109 can be injected, cast, or molded, etc. between these structural elements to complete the wall panel.

Additional wall panels 101 fabricated on this same jig (and other jigs of different geometries (e.g., 24"-wide and 36"-wide, 100"-tall panels)) at similar temperatures may therefore exhibit similarly tight dimensional and geometric tolerances. Floor panels 126 and roof panels 152 can be similarly constructed on similar floor panels 126 and roof panels 152 jigs and may therefore exhibit similarly tight tolerances.

Therefore, the panelized structural building system can include a set of wall panels 101, floor panels 126, and roof panels 152, each of which includes a set of features that define datums for accurate, repeatable location on adjacent structural panels in the panelized structural building system such that a large (e.g., a 20'-wide by 40' long) structure assembled from these structural panels exhibits high dimensional and geometric accuracy. Such high dimensional and geometric accuracy of the structure may then enable prefabricated interior façade panels to be assembled onto this structure to complete the building with little or no customization (e.g., or on-site trimming or modification) of these façade elements without sacrificing final fit and finish of the building.

Wall panels 101, floor panels 126, and roof panels 152 are described herein as constructed and assembled to form a building with a rectangular floor plan. However, wall panels 101, floor panels 126, and roof panels 152 can be assembled to form a structure defining a floor plan of any other size or geometry.

3. Wall Panel Structure

Figure 10:
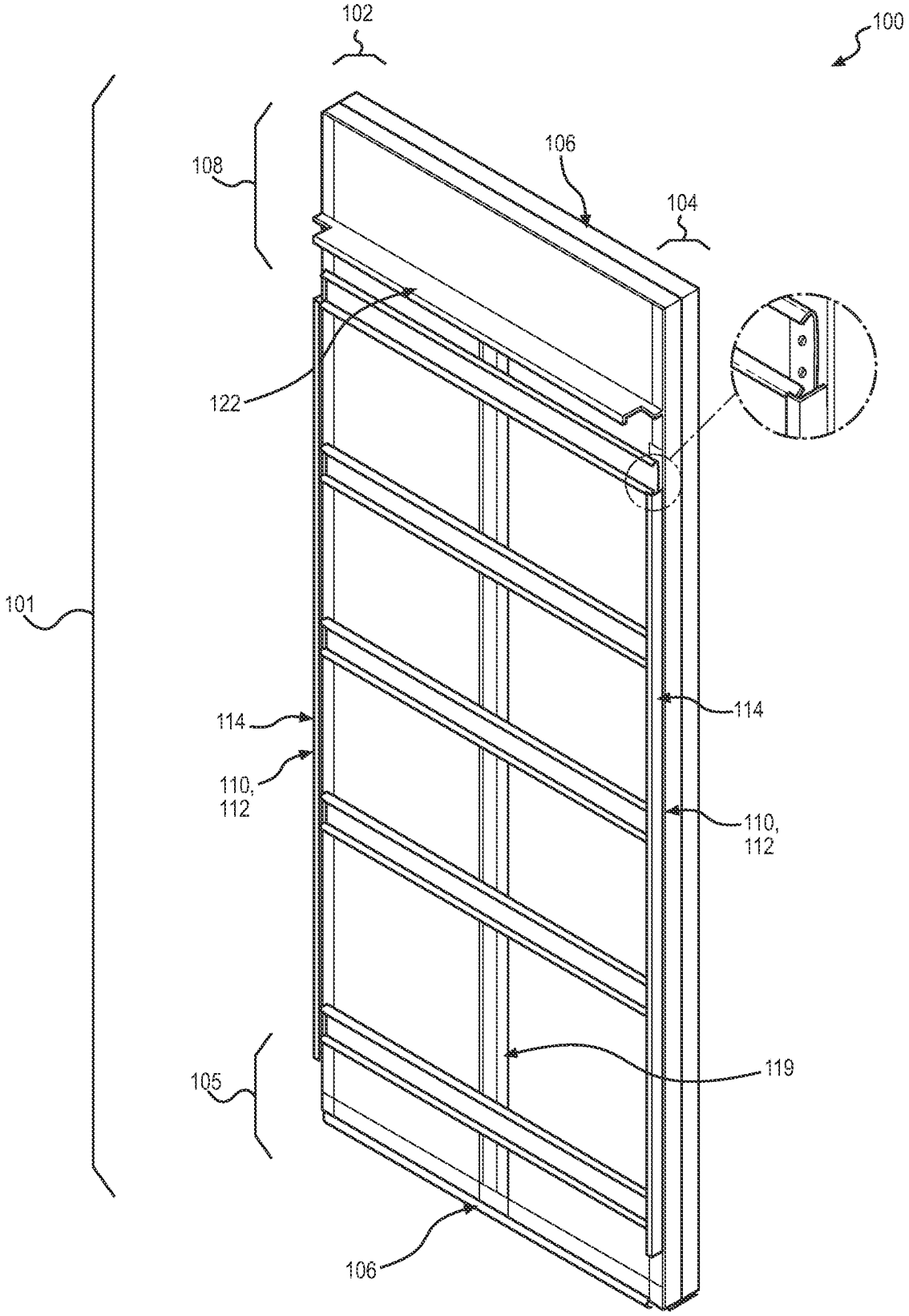
FIG. 10 is a representation of one variation of the panel system.

In one implementation, a wall panel of the panel system 100, shown in FIG. 10, includes: column elements, a flange, a footer element, a header element, an interior girt, an insulative element, datums, and a seal.

3.1 Column Elements

The column elements are vertical structural elements configured to carry vertical loads through the left and right sides of the wall panel.

In one implementation, each column element includes a folded sheet metal forming a major "U" cross-section. In this implementation, each column element can further include: a front secondary flange returning rearward from a distal end of a front leg of the major U cross-section; and a rear secondary flange returning forward from a distal end of a rear leg of the major U cross-section. In particular, these secondary flanges can extend inwardly from the legs of the major U cross-section to: increase vertical load carrying capacity of the column element; increase torsional rigidity of the column element; stiffen segments of the major U cross-section; and/or form a sealing surface between abutting faces of two adjacent wall panels 101. In one example, the left column element 102 is located in the wall panel 101 such that the open section of the major U cross-section faces laterally outwardly to form the left vertical face of the wall panel; and the right column element 104 is located in the wall panel 101 such that the open section of the major U cross-section faces laterally outwardly to form the right vertical face of the wall panel. Thus, in this implementation, the bases of the major U cross-sections of the left and right column elements 104 form continuous interior vertical surfaces extending between the front and rear faces of the wall panel.

In a closed wall panel 101 (i.e., a wall panel 101 without window, door, and other fenestration openings), these continuous interior vertical surfaces of the bases of the major U cross-sections can control expansion of foam cast in the panel to form the insulative element. Furthermore, in a fenestrated wall panel 101 (i.e., a wall panel 101 with a window, door, or other fenestration opening), these continuous interior vertical surfaces can form continuous vertical surfaces: for mounting and sealing a window or door; and for installing and finishing window or door jams around this opening. Therefore, similar or identical left and right column elements 104 can be installed in both closed and open wall panels 101.

Furthermore, because the distal ends of front and rear legs of the major U cross-section of a column element are disconnected, the distal end of the front leg of the column element can move (i.e., deflect) relative to the rear leg. In one example, a left vertical seal (e.g., a compressible silicone gasket 113) is applied to the front secondary flange of the left column element 102 of a first wall panel. When the first wall panel 101 is installed to the right of a second wall panel, the left vertical seal face compresses the front secondary flange of the right column element 104 of the second wall panel. Because the J-flanges form tightly-controlled dimensional datums on these wall panels 101 and because the geometric positions of the left and right column elements 104 in the wall panels 101 are less controlled, compression of the vertical seal between the left and right J-flange of these wall panels 101 may be non-uniform when the left J-flange of the first wall panel 101 is closed against the right J-flange of the second wall panel 101 (and when a series of clinch connections 111 are subsequently effected along the height of these J-flanges). However, because the distal ends of front and rear legs of the major U cross-sections of the left and right column elements 104 of these wall panels 101 are disconnected and because the J-flanges are mounted to the rear legs of these column elements, the front legs can deflect against the vertical seal as these wall panel 101 are connected in order to achieve more consistent compression of the vertical seal and to prevent damage to the vertical seal.

In one implementation, a wall panel 101 includes a central column element 119 arranged between the left column element 102 and the right column element 104. The central column element 119 can define a panel relief extending between the footer element 105 to the header element 108 of the wall panel 101 to house electrical and plumbing elements.

Furthermore, the column elements can be cut and formed (e.g., folded) from pre-coated (e.g., galvanized) steel sheet such that both inner and outer surfaces of the column elements are fully coated with protective material.

However, the column elements can define any other material or cross-sectional geometry.

3.2 J-Flange

Generally, the left J-flange includes: a flange extending longitudinally rearward from the left column element 102 and defining a lateral wall datum 112; and a return 114 extending laterally from the distal end of the flange toward the center of the wall panel. In particular, the left flange 110 is configured to abut a second flange of an adjacent panel and to rigidly fasten to the second flange via a series (e.g., column) of clinch connections. The left return 114 strengthens the distal edge of the flange and preserves the geometry of the flange—and therefore the geometry of the left lateral wall datum 112 of the wall panel.

The left flange no extends rearward from the left column element 102 to form a clinch surface of sufficient width to receive a clinch connection, such as 1" (or 25 millimeters) in depth. The left return 114 extends from the distal end of the flange by sufficient distance to strengthen the flange, but not obstruct access to the flange by a clinch tool, such as a width of 0.75" (or 19 millimeters).

In one implementation, the left J-flange is mounted to the left outer face of the left column element 102 and defines an L-shaped cross-section. In another implementation, the left J-flange is mounted to the rear face of the left column element 102 and defines a U-shaped cross-section.

Furthermore, the left J-flange can be welded, riveted, bonded, fastened (e.g., with a self-tapping fastener), or attached to the column element in any other way. The right J-flange defines a similar geometry.

During production of the wall panel, the position (e.g., distance, planarity, angular offset) of the flange relative to other datums on the wall panel 101 is tightly controlled in order to produce a wall panel 101 that exhibits tight dimensional and geometric tolerances on critical surfaces that set the position of the wall panel 101 relative to adjacent wall panels 101, floor panels 126, and roof panels 152 during installation. However, the position of the column elements in the wall panel 101 may be less tightly controlled—which may reduce manufacturing complexity of the wall panel 101—since the column element does not make direct, rigid contact with other adjacent wall panels 101, floor panels 126, and roof panels 152 during assembly. For example and as described below, the flanges of the J-flanges can be rigidly located on accurate and repeatable datum surfaces in a jig. The column elements and other structural elements can then be loosely located in the jig and then fastened together (e.g., with threaded fasteners) and to the J-flanges with (much) less dimensional and geometric accuracy to quickly form a rigid structure that connects these J-flanges, retains lateral offsets between the flanges of the J-flanges, and thus preserves width of the wall panel 101 and parallelism of the left and right sides of the panel defined by datum surfaces of the jig.

3.3 Footer Element

Generally, the footer element 105 is arranged at a bottom of a wall panel 101 (e.g., when the wall panel 101 is arranged vertically for installation). In one implementation, the footer element 105 includes: an inner footer panel; a center footer panel; and/or an outer footer panel.

3.3.1 Inner Footer Panel

In one implementation, the inner footer panel defines an L-channel section that extends laterally between the left and right column elements 104. A vertical segment of the L-channel section couples (e.g., fastens, welds, cinches) to the rear faces of the left and right column elements 104. A lower leg of the L-channel section extends rearward from the wall panel 101 and is offset below the column elements to enable accurate and repeatable location of the lower leg of the L-channel (e.g., in a jig during assembly) while accommodating for column elements with looser dimensional and geometric tolerances.

In one variation, the inner footer panel also includes a lower return: that extends upwardly from the lower leg substantially parallel to the L-channel section; and that functions to strengthen and retain a geometry of the lower leg of the L-channel section.

2.2.2 Center Footer Panel

The center footer panel similarly defines an L-channel section that extends laterally between the left and right column elements 104. A vertical segment of the L-channel section couples (e.g., fastens, welds, cinches) to the front faces of the left and right column elements 104. A lower leg of the L-channel section: extends rearward under the column elements; is offset below the column elements to accommodate for column elements with looser dimensional and geometric tolerances; terminates proximal a plane defined by the lower return 114 of the inner footer panel; and is fastened (e.g., welded, clinched) to the lower leg of the inner footer panel to enclose a volume under and between the column elements and to strengthen the lower leg of the inner footer panel.

3.3.3 Outer Footer Panel

The outer footer panel defines an L-channel section that extends laterally between the left and right column elements 104. A vertical segment of the L-channel section is outwardly offset from the vertical segment of the center footer panel to form a gap fillable with foam (or other insulative, shear material). A lower leg of the L-channel section: extends rearward under the center footer panel and the column elements; abuts and/or is fastened to the center footer panel; and terminates proximal the plane defined by the lower return 114 of the inner footer panel. The lower leg of the L-channel section is also fastened (e.g., welded, clinched) to both the lower leg of the inner footer panel and the lower leg of the center footer panel: to form a triple-layer structure across the base of the wall panel 101 that supports the wall panel 101 on a floor panel 126; and to define the lower vertical wall datum 106 that seats on a vertical floor datum 107 surface of a floor panel 126 to vertically locate the wall panel 101 on the floor panel 126 with tight vertical dimensional tolerances and tight horizontal geometric tolerances.

Furthermore, in one variation, the exterior façade of the wall panel 101 is cast or molded in situ across the front of the wall panel 101 as foam (or other insulative, shear material) is injected into voids within the wall panel 101—including between the vertical segments of the outer and center footer panels. In this variation, the exterior façade can be formed directly over and abut the vertical section of the outer footer panel. A lower outer corner of the outer footer panel—formed between the vertical and lower leg sections of the outer footer panel—can thus define a rigid, impact-resistant edge along the bottom of the wall panel. This lower outer edge of the outer floor panel 126 can thus protect the exterior façade from damage, such as: during transport to an install site; during installation on a floor panel 126; and once the building is fully assembled (e.g., from impact by a lawnmower or weed trimmer).

(In one variation, the wall panel 101 similarly includes left and right outer column panels that similarly: extend forward from the left and right column elements 104 to form rigid corners supporting the left and right edges of the exterior façade; and define seal interfaces configured to compress elastic seals against seal interfaces of abutting wall panels 101 when the J-flanges of the wall panel 101 are connected to J-flanges of abutting wall panels 101 via clinch connections.)

Therefore, the outer footer panel can: fully enclose the bottom of the wall panel; define an impact-resistant edge along the bottom of the exterior façade; cooperate with the inner and center footer panels to carry the full weight of the wall panel 101 (and roof panels 152 above) into the adjacent floor panel 126; and define the lower vertical wall datum 106—relative (e.g., orthogonal) to the exterior façade—that seats on a vertical floor datum 107 surface of an adjacent floor panel 126 to accurately and repeatably set a vertical height and angular (i.e., roll) position of the wall panel 101 on the adjacent floor panel 126.

3.4 Header Element

Generally, header element 108 is arranged at a top of a wall panel 101 (e.g., when the wall panel 101 is arranged vertically for installation) and defines a region for connection of the wall panel 101 to a roof panel 152.

In one implementation, the header element 108 includes: an inner header panel; a center header panel; and/or an outer header panel.

3.4.1 Inner Header Panel

The inner header panel defines an L-channel section that extends laterally between the left and right column elements 104. A vertical segment of the L-channel section couples (e.g., fastens, welds, cinches) to the rear faces of the left and right column elements 104. An upper leg of the L-channel section extends rearward from the wall panel 101 and is offset below the column elements to enable accurate and repeatable location of the upper leg of the L-channel (e.g., in a jig during assembly) while accommodating for column elements with looser dimensional and geometric tolerances.

In one variation, the inner header panel also includes an upper return: that extends upwardly from the upper leg substantially parallel to the L-channel section; and that functions to strengthen and retain a geometry of the upper leg of the L-channel section of the inner header panel.

3.4.2 Center Header Panel

The center header panel defines an L-channel section that extends laterally between the left and right column elements 104. A vertical segment of the L-channel section couples (e.g., fastens, welds, cinches) to the front faces of the left and right column elements 104. An upper leg of the L-channel section: extends rearward under the column elements; is offset below the column elements to accommodate for column elements with looser dimensional and geometric tolerances; terminates proximal a plane defined by the upper return 114 of the inner header panel; and is fastened (e.g., welded, clinched) to the upper leg of the inner header panel to enclose a volume under and between the column elements and to strengthen the upper leg of the inner header panel.

3.4.3 Outer Header Panel

The outer header panel defines a C-channel section—with horizontal return 114—that extends laterally between the left and right column elements 104. An outer vertical segment of the outer header panel abuts and extends upwardly from the wall panel 101 parallel to the exterior façade of the wall panel. A center segment of outer header panel extends rearward from the outer vertical segment and defines a lateral seal surface configured to seal against a parapet cap of an adjacent roof panel 152. An inner vertical segment of the outer header panel extends downwardly from the center segment and inset from the exterior façade of the wall panel.

Furthermore, the horizontal return: extends rearward from the inner vertical segment of the C-channel segment; extends rearward over the center header panel and the column elements; abuts and/or is fastened to the center header panel; and terminates proximal the plane defined by the upper return 114 of the inner header panel. The horizontal return 114 is also fastened (e.g., welded, clinched) to both the upper leg of the inner header panel and the upper leg of the center header panel: to form a triple-layer structure across the top of the wall panel 101 that forms a rigid structural support for a roof panel 152; and to define the upper vertical wall datum that mates with vertical roof datum surface of the adjacent roof panel 152 to vertically locate the adjacent roof panel 152 on the wall panel 101 with tight vertical dimensional tolerances and tight horizontal geometric tolerances.

The exterior façade can be formed directly over and abut the outer vertical section of the outer header panel. An upper outer corner of the outer header panel—formed between the outer vertical and center sections of the outer header panel—can further define a rigid, impact-resistant edge along the bottom of the wall panel. This upper outer edge can protect the exterior façade from damage, such as: during transport to an install site; during installation on a roof panel 152; and once the building is fully assembled (e.g., from impact by a lawnmower or weed trimmer).

In one implementation, a single seal (e.g., a silicone gasket 113): is arranged on and extends laterally across the center segment of the outer header panel; and seals against a parapet cap of an adjacent roof panel 152. In one variation, the wall panel 101 includes multiple seals: arranged on and extending laterally across the center segment of the outer header panel; longitudinally offset on the center segment; configured to seal against a parapet cap of an adjacent roof panel 152; and that cooperate to prevent water ingress between the parapet cap and the top of the wall panel.

Therefore, the outer header panel can: fully enclose the top of the wall panel; define an impact-resistant edge along the top of the exterior façade; cooperate with the inner and center header panels to carry the full weight of an adjacent roof panel 152; and define the upper vertical wall datum—relative (e.g., orthogonal) to the exterior façade—that mates with a vertical roof datum surface of an adjacent roof panel 152 to accurately and repeatably set a vertical height and angular (i.e., roll) position of the roof panel 152 on the wall panel.

3.5 Interior Girt

The wall panel 101 can further include a set of interior girts that: extend laterally across the rear (i.e., inside face) of the wall panel; and are welded or fastened to the left and right column elements 104. In particular, the set of girts can define interior façade hangers 122 to hang and locate interior façade panels on the wall panel, as described in U.S. patent application Ser. No. 17/408,202.

In one implementation, each girt includes: a left end configured to insert between the left return 114 of the left J-flange and the rear face of the left column element 102 and to fasten through the left J-flange into the left column element 102; and a right end configured to insert between the right return 114 of the right J-flange and the rear face of the left column element 102 and to fasten through the right J-flange into the right column element 104. For example, the wall panel 101 can include a set of parallel and vertically-offset girts located on 20" (or 500-millimeter) centers along the height of the wall panel.

3.6 Insulative Element

Generally, the wall panel 101 includes one or more insulative elements installed within structural sheet metal features of the wall panel. The insulative element: defines a cast-in-place material within an interior panel volume formed by the left column element 102, the right column element 104, the footer, and the header; and is configured to carry shear loads through the wall panel.

In one implementation, the insulative element: defines a pre-cast material exhibiting a geometry fitting within an interior panel volume formed by the left column element 102, the right column element 104, the footer, and the header; and is configured to carry shear loads through the first wall panel.

The panel system 100 can further include an outer insulative panel 150: bonded to an exterior surface of the footer of the wall panel 101 and an exterior edge of a floor panel 126; insulating a junction between the wall panel 101 and the floor panel 126; and defining a prefinished exterior footer surface.

3.7 Wall Datums

The wall panel 101 further includes lower and upper vertical wall datum s that control longitudinal and yaw positions of the wall panel 101 relative to adjacent wall panels 101, floor panels 126, and roof panels 152.

In one implementation, the wall panel 101 includes a lower vertical wall datum 106: extending below the outer footer panel; and configured to abut and locate on a longitudinal floor datum defined by a ledger or rim joist installed on or integrated into a perimeter of the adjacent floor panel 126. For example, the lower vertical wall datum 106 can include a pair of cylindrical bosses—of controlled diameter and extending below the outer footer panel proximal the left and right column elements 104—at controlled longitudinal (or "depth") positions that set and control a longitudinal depth of the exterior façade of the wall panel 101 relative to the longitudinal floor datum (e.g., an edge) on the ledge or rim joist when the wall panel 101 is installed over a floor panel 126. In a similar example, the lower vertical wall datum 106 includes a linear boss: that extends below and laterally across the outer footer panel; and that is configured to mate with the longitudinal floor datum on the adjacent ledger or rim joist.

Thus, in the foregoing examples, an installer may locate the wall panel 101 on a floor panel 126 with the lower vertical wall datum 106 of the wall panel 101 resting on the lower vertical floor datum 107 of the floor panel 126 to support the weight of the wall panel 101 on the floor panel 126. Then, while standing on the floor panel 126, the installer may draw (or "pull") the wall panel 101 inwardly toward the center of the building to bring the lower vertical wall datum 106(*s*)—extending below the outer footer panel—into contact with the lower longitudinal floor datum of the adjacent ledger or rim joist, thereby setting the longitudinal and yaw position of the wall panel 101 on the floor panel 126. The installer may then fasten the wall panel 101 to the adjacent floor panel 126(*s*), such as by drilling self-tapping threaded fasteners 132 through the lower leg of the inner footer panel, through the adjacent sections of the center and outer footer panels, and into the vertical floor datum 107 surface of the adjacent floor panel 126(*s*).

In another implementation, the lower return 114 of the inner footer panel—that extends upwardly from the lower leg of the inner footer panel—defines the lower vertical wall datum 106 of the wall panel. In this implementation, the lower return 114 of the inner footer panel is configured to abut a flange or other feature extending upwardly from the adjacent floor panel 126 and defining a lower longitudinal floor datum. Furthermore, in this implementation, rear edges of the horizontal legs of the center and outer footer panels are offset—from the rear face of the lower return 114 inner footer panel and toward the exterior façade of the wall panel 101—in order to avoid interference between these edges and the lower longitudinal floor datum of the adjacent floor panel 126. In similar implementations, the rear edge of the horizontal leg of the center footer panel can extend rearward past the horizontal leg of the inner and outer footer panels to form the lower vertical wall datum 106; and the rear edge of the horizontal leg of the outer footer panel can extend rearward past the horizontal leg of the inner and center footer panels to form the lower vertical wall datum 106.

Thus, in the foregoing implementations, an installer may locate the wall panel 101 on a floor panel 126 with the lower vertical wall datum 106 of the wall panel 101 resting on the lower vertical floor datum 107 of the floor panel 126 to support the weight of the wall panel 101 on the floor panel 126. Then, while standing on the floor panel 126, the installer may draw (or "pull") the wall panel 101 inwardly toward the center of the building to bring the lower vertical wall datum 106(*s*)—extending rearward from the bottom edge of the wall panel 101—into contact with the lower longitudinal floor datum that extends upwardly from the floor panel 126, thereby setting the longitudinal and yaw position of the wall panel 101 on the floor panel 126. The installer may then fasten the wall panel 101 to the adjacent floor panel 126(*s*), such as by drilling self-tapping threaded fasteners 132 through the lower leg of the inner footer panel, through the adjacent sections of the center and outer footer panels, and into the vertical floor datum 107 surface of the adjacent floor panel 126(*s*).

The wall panel 101 can include an upper vertical wall datum in a similar configuration arranged on or integrated into the upper outer, center, or inner header panel.

3.8 Seals

In one implementation, a wall panel 101 can include seals to prevent ingress of moisture, insects, or rodents into the structure including the wall panels 101 (e.g., a residential home constructed with a set of wall panels 101, floor panels 126, and roof panels 152 of the panel system) at interfaces between adjacent wall panels 101.

In one implementation, a column element of the wall panel 101 includes a gasket relief 103 extending vertically along the column element. The panel system 100 further includes a gasket 113 located along the gasket relief 103 (e.g., bonded to and/or seated within the gasket 113 relief). The gasket 113 compresses between the gasket relief 103 of a first wall panel 101 and a flange of a second right column element 104 of a second wall panel 101 during installation of the series of clinch connections.

For example, prior to installation, the gasket 113: adheres to the gasket relief 103 of a flange; and defines a height greater than a depth of the gasket 113 relief. Therefore, prior to installation, the gasket 113 extends above the wall datum defined by the flange. During installation, the gasket 113 compresses to form a gapless seal between a first wall panel 101 flange and a second wall panel 101 flange.

The panel system 100 can further include moisture barriers 115 covering each exterior-facing surface of the wall panel. Further, the panel system 100 can include moisture barrier 115 flaps configured to overlap a junction between a first wall panel 101 and a second wall panel. Therefore, an exterior surface defined by a series of wall panels 101 defines a continuously sealed moisture barrier 115, thereby preventing ingress of moisture to the structure.

4. Fenestration Panel

In one variation, shown in FIG. 3, in which the wall panel 101 includes a fenestration for a window (e.g., defining a fenestration panel 124), the inner footer panel defines a C-channel section (e.g., rather than an L-channel section). A vertical segment of the C-channel section couples (e.g., fastens, welds, cinches) to the rear faces of the left and right column elements 104. A lower leg of the C-channel section extends rearward from the column elements 104 as described above. An upper leg of the C-channel section extends rearward from the column elements 104 and forms a horizontal surface for mounting and sealing a window to the wall panel.

In this variation, the inner footer panel can also include an upper return: that extends upwardly from the upper leg substantially parallel to the C-channel section; and that functions as a window backstop, a sealable surface for the window, and/or a locating structure for installing and finishing window jams.

In one implementation, a fenestration panel 124 includes: a left column element 102; right column element 104; a fenestration element 125: a third header element; a flange; and a return flange 114.

The left column element 102 is configured to carry vertical loads through a left side of the fenestration panel 124. The right column element 104 is configured to carry vertical loads through a right side of the fenestration panel 124. The fenestration element 125: arranges between the left column and the right column; and defines a panel of glass or other transparent, rigid material. The header element 108 of the fenestration panel 124: extends between the third left column element 102 and the third right column element 104 above the footer element; and arranges above the fenestration element 125. The flange: extends rearward from the right column element 104 to mate to the first left flange 110 of the first wall panel 101 via the series of clinch connections; and defines a right lateral fenestration datum configured to laterally locate the fenestration panel 124 relative to the first wall panel. The return 114 flange: stiffens the flange; and extends laterally from the flange opposite the first wall panel.

The fenestration panel 124 and a wall panel 101 are assemblable via a series of clinch connections 111 configured to: mate the left lateral wall datum 112 of the first wall panel 101 to the right lateral fenestration datum of the fenestration panel 124; and form an interlock securing the first left flange 11*o* to the third right flange 117.

Therefore, any wall panel 101 can couple to an adjacent fenestration panel 124 to form a portion of a wall structure including a fenestration.

4.1 Wall Panel with Door

In another variation in which the wall panel 101 includes a fenestration for a door, the wall panel 101 can include: a left inner footer panel defining an L-channel section and fastened to the left column element 102 as described above; a left center footer panel fastened to the left column element 102 and the left inner footer panel as described above; a right inner footer panel similarly defining an L-channel section and fastened to the right column element 104 as described above; and a right center footer panel fastened to the right column element 104 and the right inner footer panel. In this variation, the wall panel 101 can further include a door installed between the column elements and the left and right inner and center footer panels.

5. Pre-Finished Surfaces

The panel system 100 can include a set of pre-finished surface elements configured to attach to the wall panels 101 of a panelized structure to define pre-finished surfaces such as interior walls or exterior walls.

In one implementation, a wall panel 101 can include an exterior façade mount 121 extending between the left column element 102 and the right column element 104. The further exterior façade panel 120: installs onto the exterior façade mount 121 of wall panel; and defines a prefinished exterior surface.

In one implementation, the wall panel 101 can include an interior façade hanger 122 (e.g., a girt) defining a track along an interior surface of the first wall panel. The interior finish panel: installs onto the interior façade hanger 122 of the wall panel; and defines a prefinished interior surface (e.g., a painted or papered wall).

Therefore, to change an appearance of a panelized structure, such as to change an exterior surface from wood paneling to stucco, a user can detach the exterior façade panels 120 with the wood paneled surface from the wall panels 101 and replace them with a new set of exterior façade panels 120 with a stucco surface. The interior and exterior façade panels 120 are configured to install and remove without disrupting the structural integrity of the wall panels 101 and without requiring disassembly of additional panelized elements.

6. Wall Panel Production

Generally, the foregoing structural (e.g., sheet metal) elements of the wall panel 101 can be assembled in a jig defining a set of datum surfaces configured to accurately and repeatably locate surfaces of these elements that define datum surfaces. Once these structural elements are joined (e.g., fastened, riveted, clinched, welded) together within the jig, a cover plate can be installed on the jig to enclose these assembled structural elements, and an expanding foam (e.g., a closed-cell foam) can be injected into the jig to fill volumes and voids between these structural elements and augment compressive, tensile, and shear strength of the wall panel.

In particular, the jig defines: a planar façade surface in the base (e.g., bottom) of the jig; and a set of datum reference surfaces configured to mate with and locate the left lateral wall datum 112 of the left column element 102, the right lateral wall datum 112 of the right column element 104, the lower vertical and vertical wall datum s of the footer element, and the upper vertical and vertical wall datum s of the header element.

6.1 Exterior Façade Preparation and Outer Header and Footer Panel Location

In one implementation, the interior of the jig is sprayed with a mold release compound, and a prefinished exterior façade film or sheet is then placed—finished-side-down—in the jig. The outer header and footer panels are then located in the jig: with the outer edges of the outer header and footer panels abutting and/or locating the top and bottom edges of the prefinished exterior façade film or sheet; and with the upper and lower legs of the outer header and footer panels clamped against upper and lower vertical datum reference surfaces of the jig, respectively, thereby controlling the subsequent vertical distances and roll offsets (e.g., 0° roll) between the upper and lower vertical wall datum 106*s* thus formed by the upper and lower legs of the outer header and footer panels, respectively.

In another implementation, the base of the jig is first sprayed with mold release compound, and an exterior façade coating is then applied across the base of the jig. With the exterior façade coating still wet, the outer header and footer panels are then located in the jig: with the vertical segments of the outer header and footer panels set in the wet exterior façade coating; and with the upper and lower legs of the outer header and footer panels clamped against upper and lower vertical datum reference surfaces of the jig, respectively.

Alternatively, once the exterior façade coating cured or otherwise sufficiently dry, the outer header and footer panels can be located in the jig: with an adhesive applied between and bonding the vertical segments of the outer header and footer panels to the exterior façade coating; and with the upper and lower legs of the outer header and footer panels clamped against upper and lower vertical datum reference surfaces of the jig, respectively.

6.2 Center Header and Footer Panel Location

The center header and footer panels are then installed over the outer header and footer panels, respectively, such as by bonding, riveting, and fastening. Alternatively, the center header and footer panels can be installed over the outer header and footer panels, respectively, prior to location of the outer header and footer panels in the jig.

6.3 Column Element Location

The left and right column elements 104 are then located against the center header and footer panels on each lateral side of the—and inset from lateral wall datum 112 reference surfaces defined along the lateral sides of the jig.

The left and right column elements 104 are then welded, riveted, bonded, fastened, or otherwise attached to the center header and footer panels.

6.4 Inner Header and Footer Panel Location

The inner header and footer panels are then set against the left and right column elements 104: with the upper and lower legs of the inner header and footer panels clamped against the upper and lower legs of the outer and center header and footer panels, respectively; and with the upper and lower returns of the inner header and footer panels clamped against the upper and lower references surfaces—defined in the jig—that control a maximum depth of the wall panel 101 (and/or that define upper and vertical wall datum reference surfaces in a variation described above).

The inner header and footer panels are then welded, riveted, bonded, fastened, or otherwise attached to left and right column elements 104 and the center header and footer panels.

6.5 Girts and J-Flanges

The left and right J-flanges are then set over the left and right column elements 104, and the girts are loosely set in the jig with their ends extending between the left and right J-flanges. The J-flanges are then clamped against corresponding lateral wall datum 112 reference surfaces of the jig, which control the subsequent lateral distances and angular offsets between the left and right lateral wall datums 112 thus formed by the left and right J-flanges, respectively.

A secondary girt spacing jig is located in the jig against the girts to set vertical positions of the girts within the wall panel 101 structure. The left and right column elements 104 are then welded, riveted, bonded, fastened, or otherwise attached to left and right column elements 104. The girts are similarly welded, riveted, bonded, fastened, or otherwise attached to left and right column elements 104 and/or to the left and right J-flanges.

6.6 Foam Injection

A closing panel (e.g., an inner panel or an outer panel of the wall panel) is then located over the jig to enclose these structural elements of the wall panel 101 within the jig. An expanding foam (e.g., a close-cell foam defining the insulative element) is then injected into the enclosed volume of the jig. The foam (e.g., the insulative element): expands to fill gaps, voids, and volumes between these structural elements and the exterior façade film; bonds these structural elements to increase vertical, torsional, and shear load-carrying capacity of the wall panel; insulates the wall panel; and bonds the exterior façade film to these structural elements to complete the wall panel.

6.7 Separate Foam Injection Fixture

Alternatively, once the structural elements are joined together within the jig, this assembly can be moved to and enclosed with a separate injection fixture, and an expanding foam can be injected into the injection fixture to fill volumes and voids between these structural elements and augment compressive, tensile, and shear strength of the wall panel.

However, the structural, exterior façade, and shear and insulative elements of the wall panel 101 can be assembled in any other way to form a pre-finished structural wall panel 101 with tightly controlled dimensional and geometric tolerances on a subset of surfaces configured to mate and locate the wall panel 101 relative to other adjacent wall panels 101, floor panels 126, and roof panels 152.

7. Wall Panel Installation

During assembly of a building with these prefabricated wall panels 101, floor panels 126, and roof panels 152, an installer may first: install a foundation (e.g., a set of piers) on a building site; and locate and fasten a set of floor panels 126 over the foundation to form a rigid, planar sub-floor structure that defines a continuous vertical floor datum 107 surface and a continuous longitudinal floor datum, each extending about a perimeter of the floor structure.

The installer then: places a first wall panel 101 with its lower vertical wall datum 106 resting on the vertical floor datum 107 surface in a first wall panel 101 location; draws the bottom of the first wall panel 101 inwardly from the edge of the floor structure to mate the lower vertical wall datum 106 of the first wall panel 101 with the longitudinal floor datum; and inserts a series of self-tapping threaded fasteners 132 vertically downward through the lower leg of the inner footer panel of the first wall panel 101 to fasten the first wall panel 101 to the adjacent floor panel 126(*s*).

The installer then: places a second wall panel 101 with its lower vertical wall datum 106 resting on the vertical floor datum 107 surface in a second wall panel 101 location to the left of the first wall panel; draws the bottom of the second wall panel 101 inwardly from the edge of the floor structure to mate the lower vertical wall datum 106 of the second wall panel 101 with the longitudinal floor datum; and shifts the second wall panel 101 toward the first wall panel 101 to abut the right J-flange of the second panel to the left J-flange of the first wall panel. The installer then locates a (hydraulic, pneumatic) clinch tool around the returns of these left and right J-flanges and completes a series of clinch operations with the clinch tool to form a column of clinch connections 111 between the flanges of the left and right J-flanges—such on 8" (or 200-millimeter) centers along the height of these J-flanges—thereby rigidly fastening the wall panel 101 to the floor panel 126(*s*) in an accurate and repeatable longitudinal position. The installer further inserts a series of self-tapping threaded fasteners 132 through the lower leg of the inner footer panel of the second wall panel 101 to fasten the second wall panel 101 to the adjacent floor panel 126(*s*).

The installer repeats this process for subsequent wall panels 101 to complete wall panel 101 installation for the building.

The installer then: locates a first roof panel 152 over and spanning a first opposing pair of wall panels 101; draws the top of these wall panels 101 inwardly to mate the upper vertical wall datum s of these wall panels 101 with the longitudinal roofs datums at each end of the roof panel 152; and inserts a series of self-tapping threaded fasteners 132 through the upper legs of the inner header panels of these wall panels 101 to fasten these wall panels 101 to the roof panel 152.

The installer repeats this process for each subsequent roof panel 152 to complete the roof structure and enclose the building.

In the variation described above in which the lower longitudinal floor datums of the floor panels 126 abut the lower returns of the inner footer panels of the wall panels 101 to longitudinally locate the wall panels 101 over the floor panels 126, the operator may locate the clinch tool against these flanges that define the lower longitudinal wall and floor datums and complete a series of clinch operations with the clinch tool to form a row of clinch connections 111 between these flanges—such as on 8" (or 200-millimeter) centers along the height of these J-flanges—thereby rigidly fastening the wall panel 101 to the floor panel 126(*s*) in an accurate and repeatable longitudinal position. Therefore, in this variation, the operator may assemble wall panels 101 to the floor panels 126 with clinch connections 111 rather than threaded fasteners.

7.1 Wall Panel Removal and Reinstallation

Furthermore, to dismantle a wall panel 101 from the completed building—such as for remodeling or expansion of the building—an operator may: drill, grind, punch, or otherwise remove the clinch connections 111 between the wall panel 101 and the adjacent wall panels 101; and remove the threaded fasteners 132 or clinch connections 111 joining the wall panel 101 to the adjacent floor panels 126 and roof panels 152, thereby freeing the wall panel 101 from the surrounding structure.

Because clinch connection and fastener 132 removal yields limited damage to the envelope of the wall panel, the wall panel 101 may be reused (i.e., reinstalled), in the same or other building by: locating new clinch connections 111 between locations of prior clinch connection removal along the sides (and top and bottom) of the wall panel; and/or locating threaded fasteners 132 in the same bores previously drilled in the wall panel.

For example, after removing the wall panel 101 from the building, the operator may move and reinstall the wall panel 101 in another location within an expanded footprint of the building, thereby "moving" the wall with limited skill and labor rather than demolishing the original wall and constructing a new wall from new materials. Furthermore, because clinch connections 111 are relatively small and spaced along the sides of the wall panel, the wall panel 101 may be installed, removed, and reinstalled in one or multiple buildings over time (e.g., up to four installs) with substantive reduction in the structural integrity, load capacity, or dimensional accuracy of the wall panel.

8. Horizontal Panels: Floor

Figure 2:
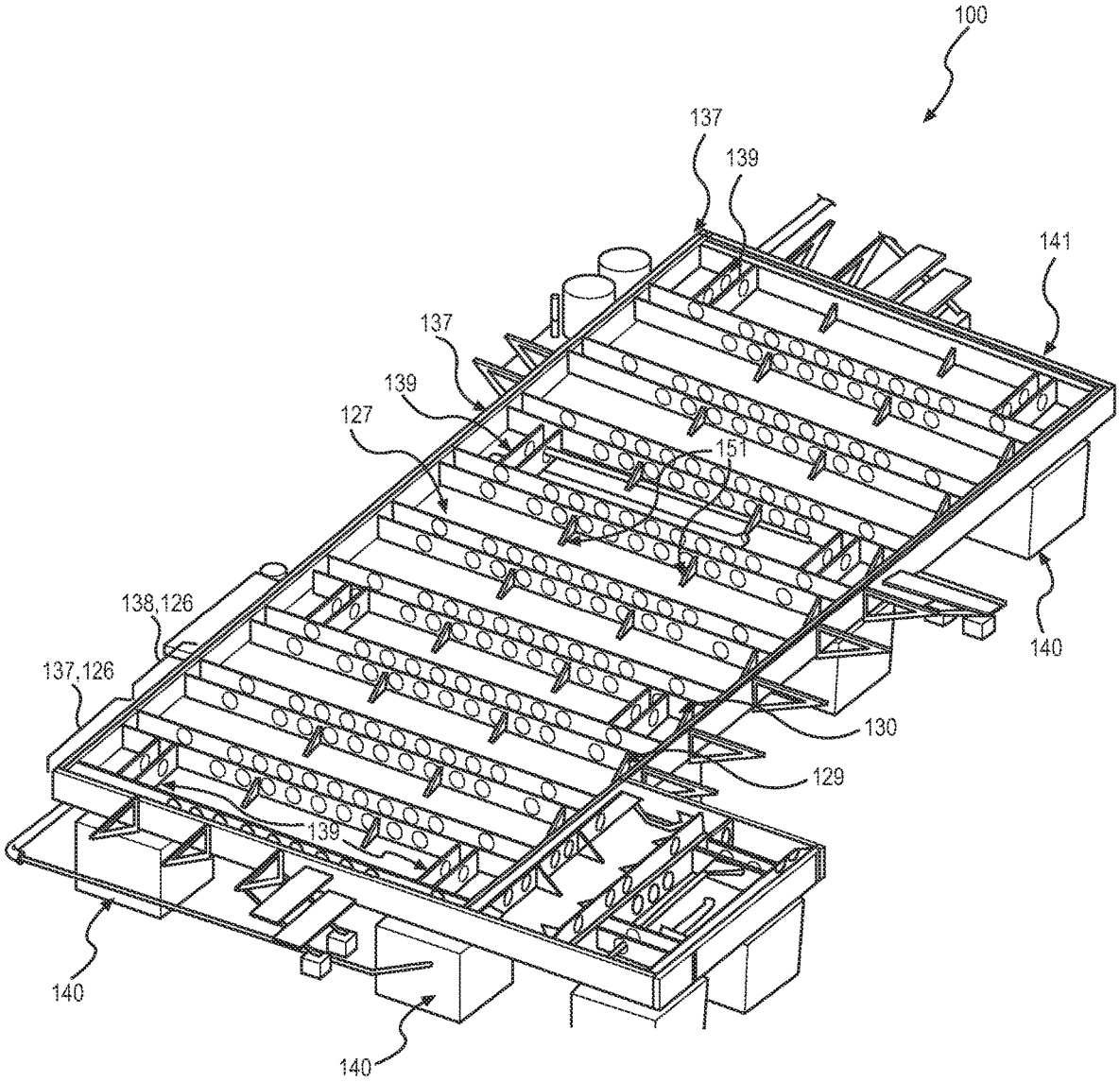
FIG. 2 is a representation of one variation of the panel system.

As shown in FIGS. 2 and 9, the panel system 100 can include a floor panel 126 including: a bottom inner panel 127; an insulative element 109 arranged below the bottom inner panel 127; a bottom outer panel 128 defining a foundation mount configured to interface with a foundation structure; a first joist 129 coupled to the bottom inner panel 127; and a second joist 130 laterally offset from the first joist 129 and coupled to the bottom inner panel 127.

The floor panel 126 further includes: a foundation mount blocking 139; a flange; a sill plate 141; a tie down 142; and a primary subfloor 143.

The foundation mount blocking 139: bridges the first joist 129 and the second joist 130; arranges over the foundation mount; and transfers forces between the foundation structure, the bottom outer panel 128, the insulative element 109, the bottom inner panel 127, the first joist 129, and the second joist 130.

The flange: couples to the bottom inner panel 127; extends upwardly from a second edge of the bottom inner panel 127; and fastens to a second floor panel 126 via a series of clinch connections.

The sill plate: couples to and extends along a top edge of the first joist 129; supports a wall panel; and defines a vertical floor datum.

The tie down 142: couples to the first joist 129; extends vertically through the sill plate 141; and fastens to the wall panel.

The primary subfloor 143: arranges over the first joist 129 and the second joist 130 opposite the bottom inner panel 127; bridges the first and second joists 130; and supports a finished flooring surface.

8.1 Horizontal Panels: Roof

Figure 5:
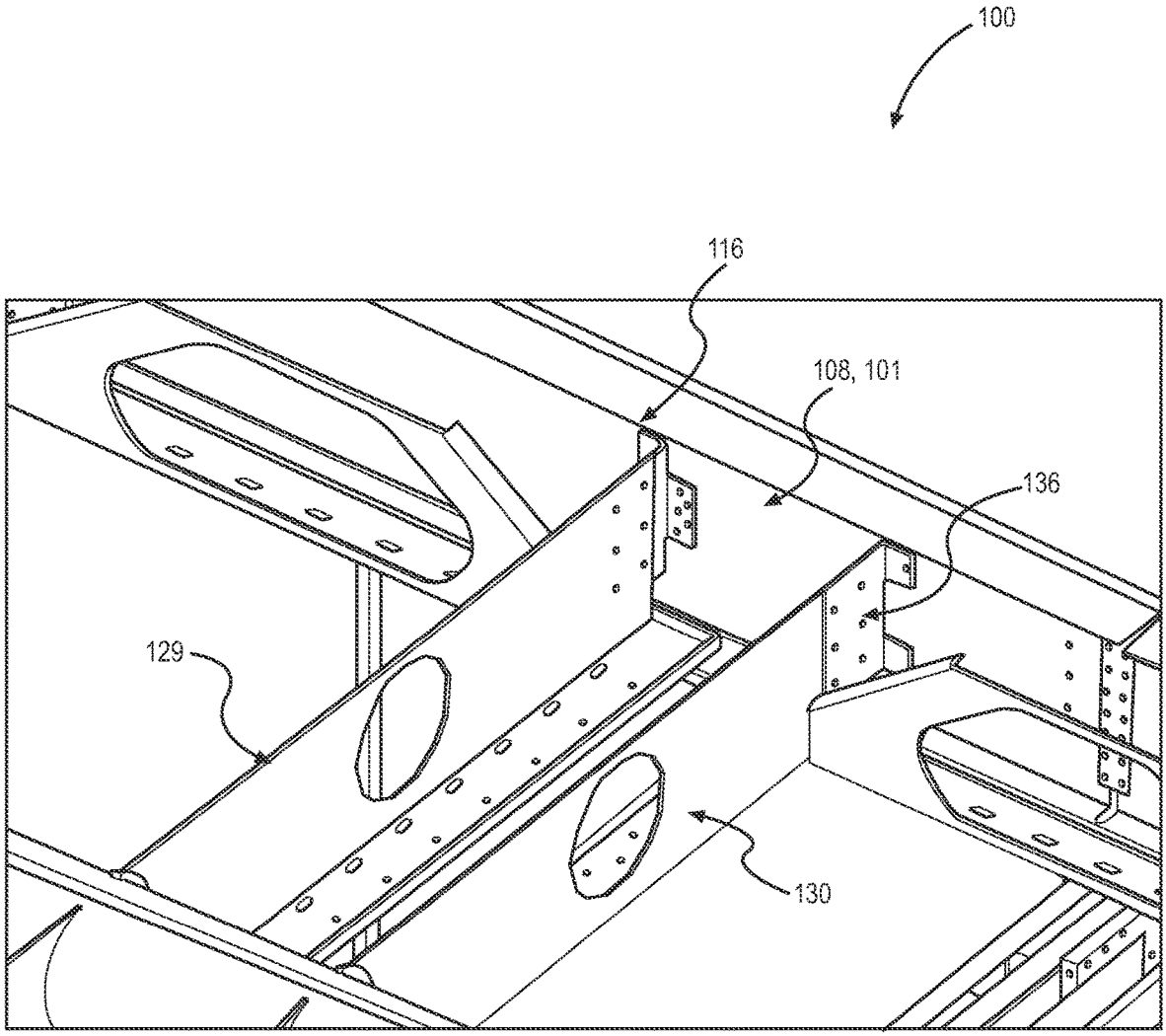
FIG. 5 is a representation of one variation of the panel system.

As shown in FIGS. 5 and 9: the panel system 100 can include a roof panel 152 including: an inner panel 127 defining a first inner panel edge configured to rest on a top plate 116 of a first wall panel; an insulative element 109 extending above the inner panel; a moisture barrier 115 arranged above the insulative element 109 and extending across an exterior surface of the roof panel 152; a first joist 129 coupled to and extending below the inner panel and offset from a first edge of the inner panel 127; a second joist 130 coupled to and extending below the inner panel, laterally offset from the first joist 129, and offset from a second edge of inner panel opposite the first edge of the inner panel; a flange coupled to the inner panel 127, extending upwardly from the second edge of the inner panel 127, and configured to fasten to a second roof panel 152 via a series of clinch connections; and a gutter mount 134 extending outwardly from the first edge of the roof panel and locating a gutter 135 over the top plate 116 of the first wall panel.

9. Horizontal Panel Applications

Generally, the building system includes a horizontal structure that—with limited addition or exchange of interior-facing elements—can form either: a structural, load-bearing floor panel 126 with precision datums that locate wall panels 101 installed above the floor panel 126; or a structural, load-bearing roof panel 152 with precision datums that locate the roof panel 152 over these wall panels 101.

More specifically, the floor panel 126 includes: a cast structural foam element interposed (or "sandwiched") between rodent- and waterproof interior- and exterior-facing metal (e.g., steel sheet) elements, that defines perimeter grooves for interfacing with and sealing against adjacent floor panels 126, and that forms primary floor insulation and a thermal break between the interior- and exterior-facing metal elements; joists that extend along the longitudinal sides of the cast structural foam element to deepen the effective section of the floor panel 126, that define nestable dentated sheet elements configured to manufacture from a single metal sheet, and that define flanges opposite the cast structural foam element to support a subfloor panel 126 and finished flooring thereover; diagonal braces that cooperate with the subfloor panel 126 to form triangulated structures across the joists and the cast structural foam element that carry a load from the floor panel 126 into a foundation pier 140 near a centerline of the cast structural foam element; and mounting brackets arranged on the longitudinal ends of the joists, configured to couple the floor panel 126 to an adjacent floor panel 126 and/or to a rim joist extending laterally across and connecting multiple floor panels 126 along the perimeter of a building, and defining datums for precision location of these adjacent floor panels 126 and/or rim joists.

Similarly, the roof panel 152 includes: a similar cast structural foam element sandwiched between similar rodent- and water-proof interior- and exterior-facing metal elements, that defines perimeter grooves for interfacing with and sealing against adjacent roof panel 152, and that forms primary roof insulation and a thermal break between the interior- and exterior-facing metal elements; similar joists that extend along the longitudinal sides of the cast structural foam element to deepen the effective section of the roof panel 152, that define nestable dentated sheet elements configured to manufacture from a single metal sheet, and that define flanges opposite the cast structural foam element to support lateral ceiling braces that hang finished ceiling panels; diagonal braces that cooperate with the lateral ceiling braces to form triangulated structures across the joists and the cast structural foam element that carry a load from the roof panel 152 into the joists and thus increase a snow load of the roof panel 152 and support installation of exterior rooftop decking over the roof panel 152; and mounting brackets arranged on the longitudinal ends of the joists, configured to couple the roof panel 152 to an adjacent roof panel 152 and defining datums for precision location of these adjacent roof panels 152.

Therefore, lateral ceiling braces or subfloor panels 143, 144 can be selectively installed on identical horizontal structures of the building system to form roof and floor panels 126, respectively.

Furthermore, each horizontal structure can form a load-bearing structure with: longitudinal and lateral datums for accurately locating adjacent horizontal structures, rim joists, or parapet caps; rodent- and water-proof exterior surfaces; insulation and thermal breaks; and structures for supporting finished interior surfaces.

For example, the floor panel 126 can form a load-bearing structure configured: to install over a foundation pier 140 near a longitudinal centerline of the floor panel 126; to cooperate with other floor panels 126 in a floor panel 126 assembly and a set of rim joists to support and accurately locate wall panels 101 around a perimeter of a building; and to communicate overhead loads into the foundation pier 140.

In a similar example, the roof panels 152 can form a load-bearing structure configured: to install over a set of wall panels 101 assembled about the perimeter of the building; and to cooperate with other roof panels 152 in a roof panels 152 assembly and a set of parapet caps to form a continuous, unsloped, and impermeable roof surface sealed over the wall panel.

10. Floor Panel Structure

Figure 11:
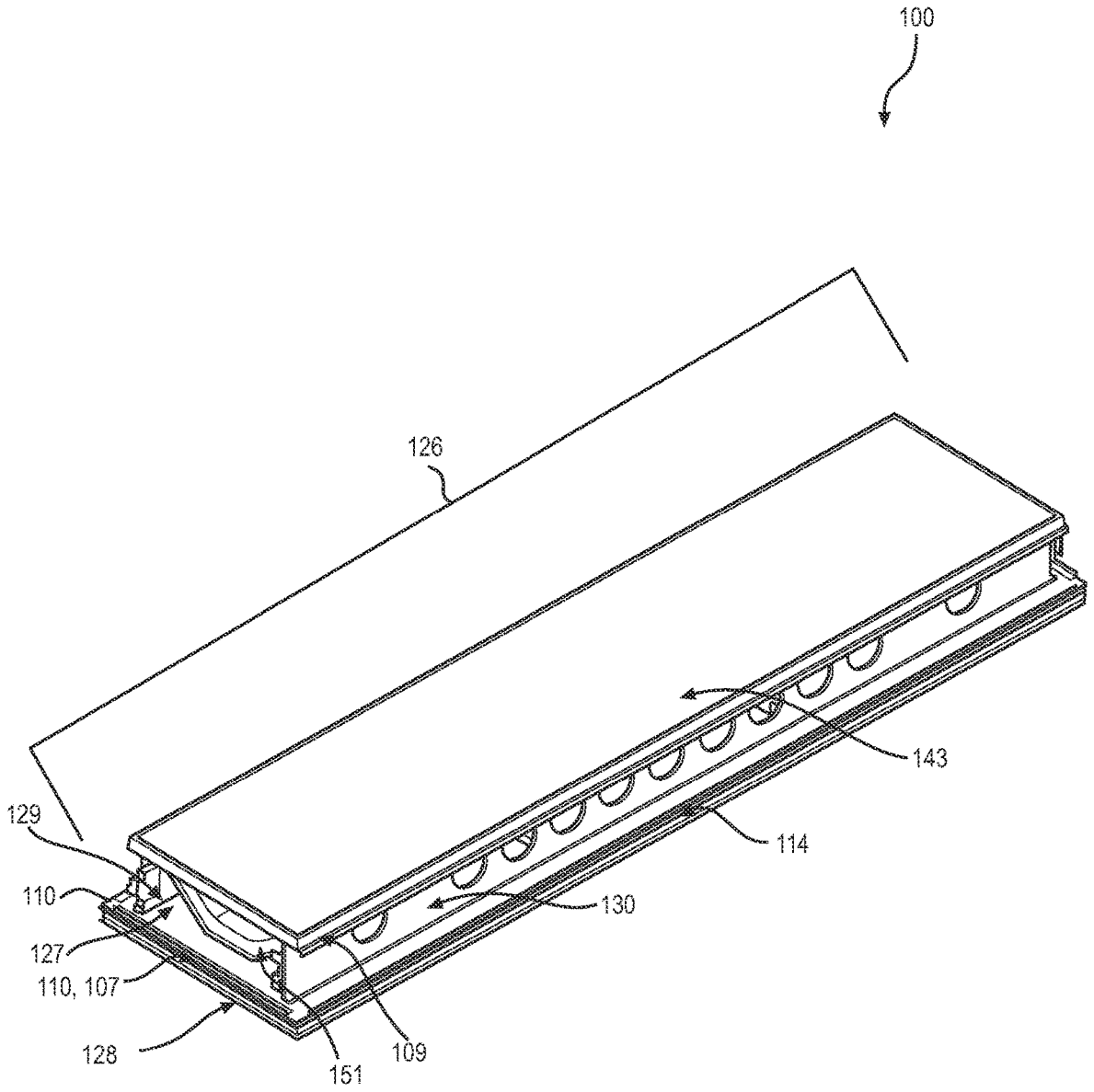
FIG. 11 is a representation of one variation of the panel system.

The floor panel 126, shown in FIG. 11, includes a bottom outer panel 128 defining: a rectangular geometry; a longitudinal centerline; and a foundation mount blocking 139 proximal the longitudinal centerline.

The floor panel 126 also includes a bottom inner panel 127: offset above the bottom outer panel 128; and defining a vertical rim joist datum configured to vertically locate a rim joist extending laterally across the floor panel 126, the rim joist defining a vertical floor datum 107 configured to locate and support a wall panel 101 off of the floor panel 126.

The floor panel 126 also includes an insulative element: cast between the bottom outer panel 128 and the bottom inner panel 127; including a first longitudinal end defining a first lateral groove extending laterally across the floor panel 126; including a second longitudinal end opposite the first longitudinal end and defining a second lateral groove extending laterally across the floor panel 126; including a left face defining a first longitudinal groove extending longitudinally along a left side of the floor panel 126; including a right face defining a second longitudinal groove extending longitudinally along a right side of the floor panel 126; and defining a primary floor-insulating body.

The floor panel 126 also includes a left joist extending parallel and inset from the left face of the insulative element 109 and including: a left lower joist section defining a boustrophedonic (or "dentated") profile intermittently coupled to the bottom inner panel 127; a left upper joist section defining a continuous linear profile offset above the bottom inner panel 127; and a left subfloor support flange extending laterally from the left upper joist edge.

The floor panel 126 similarly includes a right joist extending parallel and inset from the right face of the insulative element 109 and including: a right lower joist section defining a boustrophedonic (or "dentated") profile intermittently coupled to the bottom inner panel 127; a right upper joist section defining a continuous linear profile offset above the bottom inner panel 127; and a right subfloor support flange extending laterally from the right upper joist edge. A boustrophedonic profile of the right lower joist section of the right joist is configured to nest in the boustrophedonic profile of the left lower joist section of the left joist prior to assembly of the floor panel 126.

The floor panel 126 also includes a first left mounting bracket extending laterally from the left joist below the first longitudinal end of the insulative element. The floor panel 126 similarly includes a first right mounting bracket: extending laterally from the right joist below the first longitudinal end of the insulative element; and cooperating with the first left mounting bracket to fasten the floor panel 126 to a longitudinally adjacent floor panel 126 to form a floor panel 126 assembly.

The floor panel 126 also includes a second left mounting bracket extending laterally from the left joist below the second longitudinal end of the insulative element. The floor panel 126 similarly includes a second right mounting bracket: extending laterally from the right joist below the second longitudinal end of the insulative element; and cooperating with the first left mounting bracket to fasten the floor panel 126 to a rim joist extending laterally across the floor panel 126 assembly.

The floor panel 126 also includes: a left diagonal brace extending from the left upper joist section toward a longitudinal centerline of the bottom inner panel 127; and a right diagonal brace extending from the right upper joist section toward the longitudinal centerline of the bottom inner panel 127 and cooperating with the left diagonal brace to transfer load above the floor panel 126 into the foundation mount blocking 139.

The floor panel 126 also includes a primary subfloor 143 configured to: install over the left and right subfloor support flanges; cooperate with the left and right diagonal braces to form a triangular structure within the floor panel 126; enclose a volume above the bottom inner panel 127; and receive a finish floor covering.

The floor panel 126 similarly includes a second subfloor panel 126: configured to install between the left subfloor support flange of the floor panel 126 and a right subfloor support flange of a laterally-adjacent floor panel 126 in the floor panel 126 assembly; configured to receive the finish floor covering; and transiently removable from the floor panel 126 assembly to expose a longitudinal junction, between the insulative element 109 of the floor panel 126 and a second insulative element 109 of the laterally-adjacent floor panel 126, for fastening the left side of the floor panel 126 to a right side of the laterally-adjacent floor panel 126.

10.1. Foundation and Floating Floor Panels

In one implementation, a panelized floor structure can include foundation floor panels 137 and floating floor panels 138. Foundation floor panel 137 include foundation mounts that locate (e.g., mount, couple to) on top of a foundation pier 140 while floating panels lack foundation mounts and are supported by an adjacent foundation floor panel 137.

For example, a foundation floor panel 137 can include: a bottom inner panel 127; an insulative element 109 arranged below the bottom inner panel 127; a bottom outer panel 128 defining a foundation mount configured to interface with a foundation structure; a first joist 129 coupled to the bottom inner panel 127; a second joist 130 laterally offset from the first joist 129 and coupled to the bottom inner panel 127; a foundation mount blocking 139; a flange; a sill plate 141; a tie down 142; and a primary subfloor 143. The foundation mount blocking 139: bridges the first joist 129 and the second joist 130; arranges over the foundation mount; and transfers forces between the foundation structure, the bottom outer panel 128, the insulative element 109, the bottom inner panel 127, the first joist 129, and the second joist 130.

A floating floor panel 138 includes: a second bottom inner panel 127; a second insulative element 109 arranged below the second bottom inner panel 127; a second bottom outer panel 128; a third joist coupled to the second bottom inner panel 127; a fourth joist laterally offset from the third joist; a second flange extending upwardly from a third edge of the second bottom inner panel 127 and configured to fasten to the foundation floor panel 137 via the series of clinch connections; and a second primary subfloor 143 arranged over the third joist and the fourth joist opposite the second bottom inner panel 127, bridging the third joist and the fourth joist, and configured to support the finished flooring surface.

The foundation floor panel 137 and the floating floor panel 138 are assemblable into a section of a floor via the series of clinch connections: arranged along the foundation floor panel 137 and the second flange; and configured to form an interlock securing the flange of the foundation floor panel 137 to the second flange of the floating floor panel 138.

10.2 Rim Joist

The rim joist includes: a primary element defining a C cross-section; and a floor datum structure.

The floor datum structure includes: a horizonal flange defines vertical floor datum 107 configured to vertically locate and support a vertical wall datum of a wall panel 101 arranged over the floor panel 126; and a vertical return 114 extending downward from the horizontal flange to contact a joist of an adjacent floor panel 126.

In a longitudinal installation: the primary element is configured to fasten to joists of floor panels 126 connected in a floor panel assembly; and the vertical return 114 of the floor datum structure is configured to abut a right subfloor support flange of an adjacent floor panel 126 to carry a load of the wall panel 101 into the adjacent floor panel 126.

In a lateral installation: the primary element is configured to fasten to left and right mounting brackets on a first (or second) side of a row of floor panels 126 connected in the floor panel 126 assembly; and the vertical return 114 of the floor datum structure is configured to abut and extend between left and right subfloor support flanges of an adjacent floor panel 126 to carry a load of the wall panel 101 into the adjacent floor panel 126.

In one implementation, the rim joist extends perpendicular to the joist 129. The rim joist: couples to the first joist 129 via a first joist 129 bracket and the second joist 130 via a second joist 130 bracket; and supports a wall panel 101 arranged perpendicular to the first and second joists 130.

10.2 Cast Structural Foam Element

Generally, the insulative element 109 and outer and inner panels form a cast structural foam element with two metal surfaces sandwiching a rigid core that functions as a thermal break between these surfaces.

In one implementation: a flat steel sheet is cut to a maximal rectangular geometry of a horizontal structure to form outer and inner panels; and interior surfaces of a foam casting jig are coated with release compound. The outer panel is then set in the base of a foam casting jig, and the inner panel is set in a lid of the foam casting jig (or vice versa). The lid is then installed over the foam casting jig, and an expanding foam (e.g., a closed-cell structural foam) is injected into a void between the outer and inner panels. The foam expands to fill this void and bonds to the outer and inner panels to form a rigid foam structure sandwiched by these steel sheets.

In this implementation, sidewalls of the foam casting jig can define tongues that extend toward the center of the jig to produce a cast structural foam element that includes a continuous groove extending along the perimeter of the cast structural foam element between the outer and inner panels.

However, the outer and inner panels can be of any other material (e.g., fiberglass, aluminum, magnesium oxide board, cement board) and can be formed in any other way.

10.4 Joists

Generally, the left and right joists of one horizontal structure each define: a first continuous, linear edge configured to locate and support a finished subfloor or ceiling panel; and a second dentated (e.g., serpentine, boustrophedonic) edge—opposite the first edge—configured to fasten to the inner panel of the horizontal structure.

In particular, the left and right joists of one horizontal structure are cut from a single sheet (or continuous roll) of steel with the second dentated edges of the two joists nested together and simultaneously cut from the single steel sheet. The dentated sections of the joists thus: yield reduced weight of the horizontal structure; increase structural efficiency of the joists and the horizontal structure; reduce waste produced during fabrication of the joists; enable a single cut (e.g., laser cutting, waterjet cutting, stamping, shearing) process to form the structurally-efficient, dentated edges of the joists; and enable simultaneous production of the joists from a sheet of material of width less than the combined maximum height of the joists.

Furthermore, the joists can define continuous first edges, each transitioning into a continuous horizontal flange (i.e., a subfloor or ceiling support flange) that forms a continuous longitudinal support for a subfloor or ceiling panel.

10.5 Mounting Brackets

Each horizontal structure includes a set of four mounting brackets: extending longitudinally from the ends of the joists; configured to fasten to like mounting brackets extending from longitudinally adjacent horizontal structures; and defining datum surfaces for longitudinally locating (e.g., defining longitudinal offsets between) these horizontal structures. For example, each mounting bracket can define a steel plate perforated with through- or tapped bores and welded, fastened, bonded, or otherwise coupled to longitudinal ends of the joists.

In one implementation, the mounting brackets on a first side of the joists and the corresponding first end of the cast structural foam element terminate at the same vertical plane. In particular, the mounting brackets can be referenced to the ends of the cast structural foam element and/or to the planar surfaces defined by the outer or inner panels when the mounting brackets are assembled onto the horizontal structure. Accordingly, a seal can be placed in a groove along this first end of the cast structural foam element. The seal and the first end of the cast structural foam element of this horizontal structure can be abutted against a similar groove and end in the cast structural foam element of an adjacent horizontal structure, thereby bringing the first two mounting brackets of the horizontal structure into contact with the corresponding mounting brackets of the adjacent horizontal structure with the outer panels falling on the same horizontal plane.

Alternatively, the first end of the cast structural foam element can define a datum surface, and the adjacent mounting brackets can be slightly inset from the vertical plane defined by this first end of the cast structural foam element. Accordingly, an installer may insert shims between abutting mounting brackets of two adjacent horizontal structures—in order to bring the planes formed by the outer (or inner) panels to the same horizontal plane—when fastening these mounting brackets together.

In another variation, the mounting brackets on the first side of the joists are inset from the vertical plane defined by the first end of the cast structural foam element. Accordingly, an installer may install a girder between ends of adjacent horizontal structures such that: the girder extends laterally across multiple horizontal structures; and mounting brackets of multiple horizontal structures facing and adjacent the girder are fastened to and supported on the girders, thereby increasing lateral rigidity of the assembly of horizontal structures. Additionally or alternatively, in this variation, the inset mounting brackets can define longitudinal roof datums configured to abut an interior wall datum defined by an adjacent wall panel 101 in order to set a longitudinal position of the roof panels 152 relative to the wall panel 101 when the wall panel 101 is set in a corner or at an end of a column assembly of roof panels 152.

In one implementation, the panel system 100 includes blocking brackets 151: extending between the first joist 129 and the second joist 130; and configured to prevent rolling of the first joist 129 and the second joist 130.

10.6 Joist and Mounting Bracket Assembly onto Horizontal Structure

In one implementation, a joist assembly jig defines a set of reference datum surfaces: that locate an inner surface of the cast structural foam element; that locate top edges of joists opposite the inner panel to define a vertical datum relative to the inner surface of cast structural foam element, which a) seats on a vertical wall datum of a wall panel 101 and which b) forms a lower attachment surface between cast structural foam elements in the floor panel 126 configuration; and that locate mounting brackets above and relative to edges of the cast structural foam element and relative to surfaces of the outer or inner panels such that these mounting brackets form datums for accurate assembly against mounting brackets of adjacent horizontal structures and for accurate location of rim joists in the floor panel 126 configuration.

For example, the cast structural foam element can be located in the joist assembly jig: with the outer panel facing downwardly; and with the outer (or inner) panel supported on a lower horizontal planar reference datum surface. The four mounting brackets can be located (e.g., clamped) onto corresponding vertical reference data surfaces offset above the cast structural foam element. The left and right joists can be located in the jig with their first, continuous edges clamped against an upper horizontal planar reference datum surface offset above the lower horizontal planar reference datum surface by a target thickness of the horizontal structure. Ends of the joists can then be located and fastened against their corresponding mounting brackets (e.g., with self-tapping fasteners). A first L-bracket is then inserted over a gap between the second, dentated edge of the first joist 129 and the inner panel, and the first L-bracket, the first joist 129, and the inner panel are then fastened together (e.g., with self-tapping fasteners). This process is repeated for a second L-bracket and the second joist 130. In this example, diagonal braces are then installed between the joists and the inner panel to complete the horizontal structure.

10.7 Rim Joist

In one implementation, an assembly of floor panels can couple to a rim joist for additional support. The rim joist includes a C-channel section and an L-channel section. The C-channel section: is configured to fasten across a row of mounting brackets on one end of a set of assembled floor panels 126 in a lateral configuration; and is configured to fasten across an outer column of joists of a set of assembled floor panels 126 in a longitudinal configuration. The L-channel section includes: an upper horizontal leg arranged over and extending rearward from the upper horizontal leg of the C-channel section; and a lower vertical leg extending downwardly from the upper horizontal leg to meet the subfloor support flange(s) of the adjacent floor panel 126(*s*).

In particular, the center vertical section of the C-channel section forms a primary connection to mounting brackets or joists of a set of floor panels 126 and defines horizontal datum for lateral or longitudinal location of the rim joist on the floor panel 126 assembly. The lower leg of the L-channel section defines a datum configured to locate against subfloor support flanges of a set of wall panels 101 to define a vertical position of the rim joist on the floor panel 126 assembly and carries (some) vertical load of wall panels 101 installed over the floor panel 126 assembly into the subfloor support flanges. The upper leg of the L-channel section defines a vertical floor datum 107 for vertically locating a wall panel 101 over the floor panel 126. The upper leg of the C-channel section cooperates with the upper leg of the L-channel section to carry load from the wall panel 101 installed above into the joist(es) of the adjacent floor panel 126(*s*).

Alternatively, rather than fabricating from multiple discrete sheet metal sections, the rim joist can be extruded (e.g., in aluminum) to form a continuous unitary rim joist defining a similar geometry.

10.8 Seals

In one implementation, the floor panels 126 and roof panels 152 can include seals to prevent drafts and/propellant reservoir ingress of moisture, insects, or rodents.

In one implementation, the floor panels 126 and roof panels 152 can include a moisture barrier 115 flap configured to overlap a junction between a first panel and a second panel to prevent ingress of moisture.

The floor panels 126 and roof panels 152 can further include a gasket relief 103 extending along a flange of the panel. A gasket 113: installs along the gasket relief 103; and compresses between the gasket relief 103 of a first panel and a flange of a second, adjacent panel during installation of the series of clinch connections.

11. Roof Panel Structure

Figure 12:
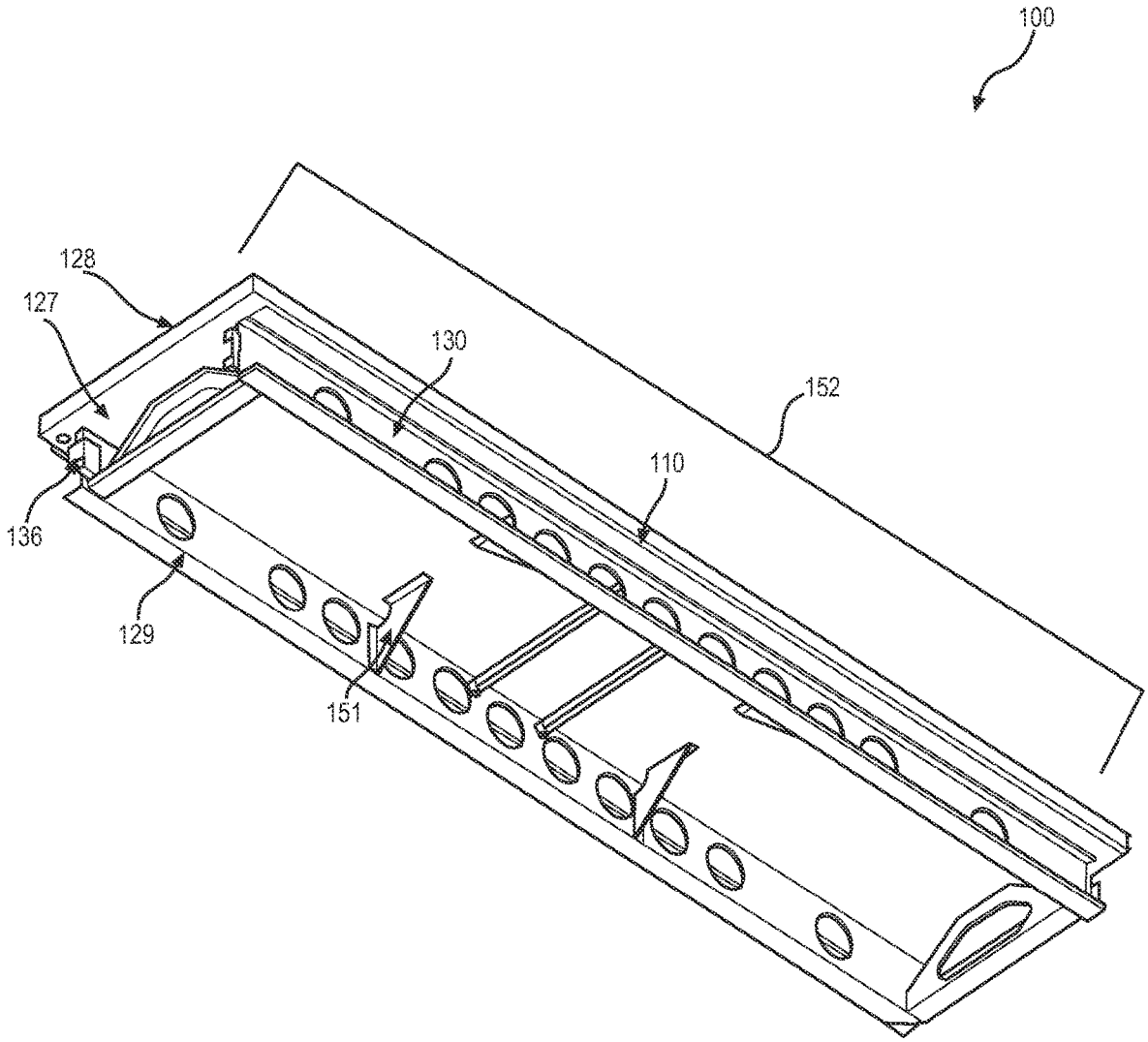
FIG. 12 is a representation of one variation of the panel system.

A roof panel 152, shown in FIG. 12, is structurally analogous to the floor panel 126 and is configured to install overhead the floor panel 126 in a configuration inverted from the floor panel 126.

In particular, the roof panel 152 roof panels 152 includes an outer panel defining: a rectangular geometry; a longitudinal centerline; and a planar roofing surface including an impermeable moisture barrier 115.

The roof panel 152 also includes an inner panel: offset below the outer panel; and defining a vertical roof datum configured to seat on a vertical wall datum of an adjacent wall panel 101 to support and vertically locate the roof panel 152 on the wall panel.

The roof panel 152 also includes an insulative element: cast between the outer panel and the inner panel; including a first longitudinal end defining a first lateral groove extending laterally across the roof panel 152; including a second longitudinal end opposite the first longitudinal end and defining a second lateral groove extending laterally across the roof panel 152; including a left face defining a first longitudinal groove extending longitudinally along a left side of the roof panel 152; including a right face defining a second longitudinal groove extending longitudinally along a right side of the roof panel 152; and defining a primary roof-insulating body.

The roof panel 152 also includes a left joist extending parallel and inset from the left face of the insulative element 109 and including: a left upper joist section defining a boustrophedonic profile intermittently coupled to the inner panel; a left lower joist section defining a continuous linear profile offset below the inner panel; and a left ceiling support flange extending laterally from the left lower joist edge.

The roof panel 152 similarly includes a right joist extending parallel and inset from the right face of the insulative element 109 and including: a right upper joist section defining a boustrophedonic profile intermittently coupled to the inner panel; a right lower joist section defining a continuous linear profile offset below the inner panel; and a right ceiling support flange extending laterally from the right lower joist edge. The right upper joist section of the right joist is configured to nest in the left upper joist section of the left joist prior to assembly of the roof panel 152.

The roof panel 152 also includes: a first left mounting bracket extending laterally from the left joist above the first longitudinal end of the insulative element; and a first right mounting bracket extending laterally from the right joist above the first longitudinal end of the insulative element 109 and cooperating with the first left mounting bracket to fasten the roof panel 152 to a longitudinally adjacent roof panel 152 to form a roof panel 152 assembly.

The roof panel 152 also includes: a left diagonal brace extending from the left lower joist section toward a longitudinal centerline of the inner panel; and a right diagonal brace extending from the right lower joist section toward the longitudinal centerline of the inner panel and cooperating with the left diagonal brace to support the longitudinal centerline of the outer panel against roof loads.

The roof panel 152 also includes a lateral ceiling brace: extending laterally between the left ceiling support flange and the right ceiling support flange over the left and right diagonal braces to form a triangular structural element; and configured to hang a finished ceiling panel.

11.1 Parapet Cap

In one implementation, the roof panel 152 includes a parapet cap defining: a roof flange configured to extend over and seal along an edge of an outer panel of an adjacent roof panel 152 supporting the side of the roof panel 152; a vertical section extending downward from the roof flange to enclose a side of the adjacent roof panel 152; and a wall flange. The wall flange: extends outwardly from the vertical section below and opposite the roof flange; is configured to extend past an exterior façade of the adjacent wall panel; and defines a roof seal interface configured to seal against a wall surface along a top surface of the adjacent wall panel.

11.2 Gutter

In one implementation, shown in FIG. 6, the roof panel 152 includes a gutter mount 134: extending outwardly from an edge of the roof panel 152; and configured to support and locate a gutter 135 over a top plate 116 of the wall panel. The gutter mount 134 can include a set of clips or struts arranged along an edge of the roof (e.g., an edge of the roof panel 152 not abutting another roof panel 152) and figured to support a gutter 135 structure separate from the roof panel 152.

For example, for two adjacent roof panels 152, the first roof panel 152 defines a first gutter mount 134, and the second roof panel 152 defines a second gutter mount 134. The first and second gutter mounts 134 cooperate to support the gutter 135 at a target angle for flow of water through the gutter 135. For example, the panelized structure can further include a downspout located along any portion of the gutter 135 to drain water in the gutter 135.

In one implementation, a series of gutter mounts 134 can be installed on an assembly of roof panels 152, such as to support the gutter at a target angle such that for every 10 feet of gutter, the gutter slopes one quarter to one half of an inch. After installation of the gutter mounts 134, an installer can install a gutter 135 onto the gutter mounts 134 such that the gutter occupies the target angle. In one implementation, the gutter mounts 134 can include a locking mechanism, clip, or fastener to retain the gutter in place.

11.3. Lateral Ceiling Brace

In one implementation, lateral braces are installed across the joists to complete a roof panel 152. For example, two lateral braces can be installed across the joists and fastened to the ceiling support flanges of these joists, such as with self-tapping screws. The complete floor panel 126 is then removed from the jig.

12. Structure Assembly

In one implementation, each of the components described above is assemblable into a residential structure via the following processes.

12.1 Floor Assembly

In one implementation, to install a floor panel 126 assembly (e.g., a set of floor panels assembled via clinch connections) of a building, an installer installs a set of pier foundations at predefined lateral and longitudinal intervals that correspond to: lateral and longitudinal centerlines of a group of assembled (i.e., interconnected) floor panels 126; and positions of foundation mount blockings 139 on outer panels of a subset of floor panels 126 in the floor panel 126 assembly.

The installer than: fastens a first floor panel 126 on a first foundation pier 140; braces the first floor panel 126 in a horizontal orientation; and locates a continuous preformed gasket 113 or a set of (e.g., four) discrete preformed gaskets 113 in the grooves on the sides of the cast structural foam element of the floor panel 126.

The installer then offers a second floor panel 126 up to the first floor panel 126 and loosely fastens the abutting mounting brackets of the first and second floor panels 126. The installer repeats this process to assemble a first column of floor panels 126 along a first edge of the building and spanning two (or more) foundation piers 140.

The installer then locates a first rim joist along a first longitudinal side of the floor panel 126 assembly, including: locating the bottom flange of the C-channel section rim joist element against the inner panels of these floor panels 126 between the outer longitudinal edges and adjacent joists of these floor panels 126; and locating the lower vertical leg of the L-channel section rim joist element on the exposed subfloor support flanges of these adjacent joists.

The installer then tightens the abutting mounting brackets of these floor panels 126 together (and selectively inserts shims therebetween) to: bring the subfloor panels 143, 144 on the floor panels 126 into a common plane; reduce and eliminate a gap between the bottom flange of the C-channel section rim joist element and the inner panels of these floor panels 126; and reduce and eliminate a gap between the lower vertical leg of the L-channel section rim joist element and the subfloor support flanges of the adjacent joists of these floor panels 126.

The installer then fastens the rim joist to the floor panels 126 by: inserting a first set of fasteners 132 vertically through the bottom flange of the C-channel section rim joist element and the inner panels of these floor panels 126; and inserting a second set of fasteners 132 horizontally through the vertical center section of the C-channel section rim joist element and the vertical sections of the adjacent joists of these floor panels 126.

The installer then: installs a fastening strip along a first longitudinal edge of the inner panels of each floor panel 126; installs gaskets 113 in grooves of these floor panels 126; sets floor panels 126 in this second column against the floor panels 126 in the first column; braces the free longitudinal sides of these floor panels 126; loosely fastens abutting mounting brackets of floor panels 126 in this second column; and reaches between the adjacent joists of floor panels 126 in the first and second columns to install fasteners 132 through the fastening strip and into the inner panels of the first column of floor panels 126.

The installer then locates a first lateral rim joist across the first end of the first floor panel 126 in the first column and spanning the first end of a first floor panel 126 in the second column, including: locating the bottom flange of the C-channel section rim joist element against the inner panels of these floor panels 126 between the outer longitudinal edges and outer mounting brackets of these floor panels 126; and locating the lower vertical leg of the L-channel section rim joist element on the four exposed ends of the subfloor support flanges of these adjacent joists.

The installer repeats this process to locate a second lateral rim joist across the second end of the last floor panel 126 in the first column and spanning the second end of a last floor panel 126 in the second column. The installer then tightens the abutting mounting brackets of the second column of floor panels 126 together (and selectively inserts shims therebetween) to: bring the subfloor panels 143,144 on the second column of floor panels 126 into a common plane with the first column of floor panels 126; reduce and eliminate a gap between the bottom flange of the C-channel section rim joist element and the inner panels of floor panels 126 at the first end and second ends of this floor panel 126 assembly; and reduce and eliminate a gap between the lower vertical leg of the L-channel section rim joist element and the subfloor support flanges of the adjacent joists of these floor panels 126 at the first end and second ends of this floor panel 126 assembly.

The installer then fastens the first and second lateral rim joists to the first and second floor panel 126 columns by: inserting a first set of fasteners 132 vertically through the bottom flange of the C-channel section rim joist element and the inner panels of these floor panels 126; and inserting a second set of fasteners 132 horizontally through the vertical center section of the C-channel section rim joist element and the outer mounting brackets of the adjacent joists of these floor panels 126.

The installer repeats this process for each other column of floor panels 126 to complete the floor panel 126 assembly, including rim joists extending about the full perimeter of the floor panel 126 assembly. The installer then locates secondary subfloor 144 panels 126 over lateral and longitudinal junctions between abutting floor panels 126, thereby covering access areas for accessing and installing fastener 132 strips between inner panels of abutting floor panels 126. The installer later installs finished flooring over the primary and second subfloor panels 143,144 to form a continuous floor surface over the floor panel 126 assembly.

The installer then locates and fastens a set of wall panels 101 onto these rim joists to complete the exterior walls of the building and to form a continuous vertical roof datum surface extending about a perimeter of the building envelope.

In one implementation, a rigid subfloor panel 126 is installed across the joists to complete a floor panel 126. For example, the subfloor panel 126 can include wood, plywood, fiberglass, metal sheet, film, or veneer sandwiching a foam core. For example, the subfloor panel 126 can be fastened or bonded to the joists of the floor panel 126.

In particular, the longitudinal edges of the subfloor panel 126 can extend between the longitudinal centerlines of the subfloor support flanges such that outer sections of the subfloor support flanges remain exposed. The completed floor panel 126 is then removed from the jig. A rigid (e.g., steel) plate, a slip plate (e.g., nylon sheet), or a thrust bearing, etc. is then installed (e.g., fastened, bonded) to the outer panel opposite a junction between the diagonal braces and the inner panel to form a foundation mount blocking 139.

In one implementation, the panel system 100 includes a primary subfloor 143 and a secondary subfloor 144. The primary subfloor 143 extends between the first and second joist 130 of a first floor panel 126. The secondary subfloor 144: defines a strip of subflooring; bridges the second joist 130 of the first floor panel 126 and a third joist of an adjacent floor panel 126; abuts the primary subfloor 143 of the first floor panel 126 and the primary subfloor 143 of the second floor panel 126; and removably nests over the flanges of the first and second floor panel 126 for installation of the series of clinch connections.

12.2 Roof Assembly

The installer then: installs a preformed elastic seal or gasket 113 along a continuous seal interface defined along the tops of the wall panels 101; and locates a first roof panel 152 over a set of wall panels 101 defining a first corner of the building such that the inner panel seats on upper vertical wall datum s defined by these wall panels 101.

The installer then: arranges a second roof panel 152 adjacent to the first roof panel 152; locates a first side of the inner panel of the second roof panel 152 on the top of the adjacent wall panel; loosely fastens the abutting mounting brackets of the first and second roof panels 152; and braces the second free edge of the roof panels 152 over the floor panel 126 assembly of the building.

The installer then repeats this process to assemble a first column of roof panels 152 along a first edge of the building and spanning the two opposing end walls of the building.

The installer then locates a first parapet cap along a first longitudinal side of the roof panels 152 assembly (e.g., a set of roof panels assembled via clinch connections) including: locating the top flange of the parapet cap over the outer panels of these roof panels 152; locating the center section of the parapet cap against the longitudinal sides of these roof panels 152 arranged over the wall panel; and locating the lower flange of the parapet cap over the top of the adjacent wall panels 101 and sealing against the seal(s) arranged over the tops of these wall panels 101.

The installer then tightens the abutting mounting brackets of these roof panels 152 together (and selectively inserts shims therebetween) to bring the ceiling support flanges of these roof panels 152 into a common plane.

The installer then fastens the parapet cap to the roof panels 152 by: inserting a first set of fasteners 132 vertically through the upper flange of the parapet cap and into the outer panels of these roof panels 152; and inserting a second set of fasteners 132 vertically through the lower flange of the parapet cap and tops of the adjacent wall panels 101—outside of the seal(s).

The installer then: installs a fastening strip and gasket 113 along a first longitudinal edge of the outer panels of each roof panel 152 allocated for a next roof panel 152 column; installs gaskets 113 in grooves of these roof panels 152; sets roof panels 152 in this second column against the roof panels 152 in the first column with the fastening strips of this second column of roof panels 152 set against the second longitudinal edges of the outer panels of the first column of roof panels 152; braces the free longitudinal sides of this second column of roof panels 152; and loosely fastens abutting mounting brackets of roof panels 152 in this second column.

The installer then tightens the abutting mounting brackets of the second column of roof panels 152 together (and selectively inserts shims therebetween) to: bring the ceiling support flanges of these roof panels 152 into a common plane; and bring the outer panels of the first and second roof panels 152 columns into a common plane.

The installer then fastens the first column of roof panels 152 to the second column of roof panels 152 by driving fasteners 132 through the fastening strips and into the outer panels of the first column of roof panels 152.

The installer then locates a first lateral parapet cap across the first end of the first roof panel 152 in the first column and spanning the first end of a first roof panel 152 in the second column, including: locating the top flange of the second parapet cap over the outer panels of these roof panels 152; locating the center section of the second parapet cap against the first lateral sides of these roof panels 152; and locating the lower flange of the second parapet cap over the top of the adjacent wall panels 101 and sealing against the seal(s) arranged over the tops of these wall panels 101.

The installer repeats this process to locate a second lateral parapet cap across the second end of the last roof panel 152 in the first column and spanning the second end of a last roof panel 152 in the second column.

The installer then fastens the first and second lateral parapet caps to the first and second roof panel 152 columns by: inserting a first set of fasteners 132 vertically through the upper flanges of the lateral parapet caps and into the outer panels of these roof panels 152; and inserting a second set of fasteners 132 vertically through the lower flanges of these lateral parapet caps and tops of the adjacent wall panels 101—outside of the seal(s).

The installer repeats this process for each other column of roof panels 152 to complete the roof panel 152 assembly, including parapet caps extending about the full perimeter of the roof panel 152 assembly.

The installer later hangs finished interior ceiling panels from the ceiling support flange of the roof panels 152.

In one implementation, a roof panel 152 can mate to an adjacent roof panel 152 to form a planar-horizontal, non-sloped roof assembly via a series of clinch connections 111. The clinch connections 111 are: arranged along the first flange of the roof panel 152 and the second flange of the second roof panel 152; and configured to form an interlock securing the first flange to the second flange. Therefore, an installer can mate a first and second roof panels 152 without use of a series of fasteners 132 by installing a series of clinch connections 111 via a clinch tool.

12.3 Wall to Floor Assembly

A wall panel 101 couples to a floor panel 126 via clinch connections, fasteners 132, tie downs 142, or any combination thereof.

In one implementation, the wall panel 101 includes a lower flange extending rearward from the footer element. The lower flange defines: a lower vertical wall datum 106 configured to seat against the vertical floor datum 107 of the floor panel 126 to locate the wall panel 101 relative to the floor panel 126; and a surface for a series of clinch connections 111 to a flange of a floor panel 126. The floor panel 126 includes a vertical flange: defining the vertical floor datum 107 configured to vertically locate and support a lower vertical wall datum 106 of a wall panel 101 arranged over the floor panel 126. For example, the wall panel 101 and the floor panel 126 are assemblable via the series of clinch connections 111 configured to: mate the lower vertical wall datum 106 of the first wall panel to the vertical floor datum 107 of the floor panel 126; and form an interlock securing the lower flange of the first wall panel 101 to the vertical flange of the floor panel 126.

In one implementation, the wall panel 101 and the floor panel 126 connect via a series of fasteners 132 running through a series of fastener bores 131 mating a flange of the wall panel 101 to a flange of the floor panel 126. For example, the wall panel 101 can include a lower flange extending rearward from the footer element 105 defining: a lower vertical wall datum 106 configured to seat against a floor datum of the floor panel 126 to locate the wall panel 101 relative to the floor panel 126; and a first set of fastener bores. In this example, the floor panel 126 includes a vertical flange defining: a vertical floor datum 107 configured to vertically locate and support a lower vertical wall datum 106 of a wall panel 101 arranged over the floor panel 126; and a second set of fastener bores. The wall panel 101 and the floor panel 126 are assemblable via a series of fasteners 132 configured to: install within the first set of fastener bores 131 and the second set of fastener bores; and mate the lower vertical wall datum 106 of the first wall to the vertical floor datum 107 of the floor panel 126.

In one implementation, the panel system 100 further includes a tapered pin. Before clinching and/or fastening of the wall panel 101 and the floor panel 126 together, an installer inserts the tapered pin into a first fastener bore 131 of the wall panel 101 through to a second fastener bore 131 of the floor panel 126. The installer can leverage the tapered pin to align the wall panel 101 to a position relative to the floor panel 126 and fasten the wall panel 101 to the floor panel 126.

In one implementation, the footer of the wall panel 101 defines a tie down 142 bore configured to receive a tie down 142 extending from a rim joist or a floor panel 126. An installer can lower the wall panel 101 onto the floor panel 126 such that the tie down 142 of the floor panel 126 installs within the tie down 142 bore of the wall panel 101 to mate the lower vertical wall datum 106 of the wall panel 101 to the vertical floor datum 107 of the foundation floor panel 137.

12.4 Wall to Roof Assembly

A roof panel 152 is configured to rest on top of a wall panel 101 or set of wall panels 101. For example, the wall panel 101 includes a top plate: extending along a top edge of the wall panel 101 between the left and right column elements 104; that defines an upper vertical wall datum configured to vertically locate the roof panel 152 relative to the wall panel.

In one implementation, the joists of a roof panel 152 hang down from the inner panel of the roof panel 152 and abut the headers of adjacent wall panels 101. The wall panel 101 fastens to a roof panel 152 via a joist bracket 136. The joist bracket 136 defines: a first surface configured to couple to the joist via a series of fasteners; and a second surface configured to couple to an interior surface of the header of the wall panel 101 via another series of fasteners.

12.5 Assembled Structure

Figure 13:
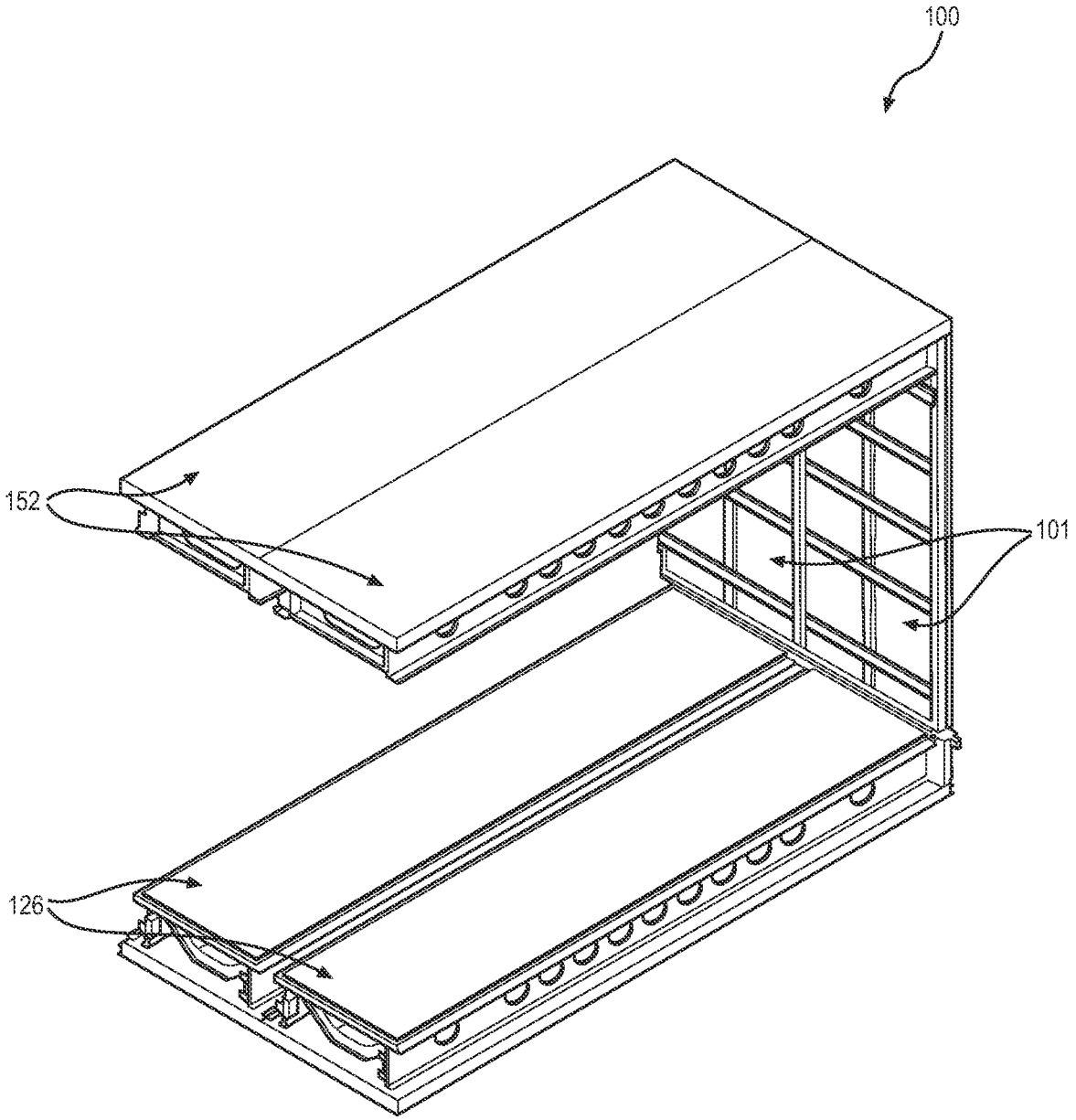
FIG. 13 is a representation of one variation of the panel system.

In one implementation, shown in FIG. 13, a panelized structure includes a set of wall panels 101, floor panels 126, and roof panels 152 assembled as described above.

For example, a panelized structure can include a set of floor panels 126 each including: a bottom inner panel 127; an insulative element 109 arranged below the bottom inner panel 127; a bottom outer panel 128 defining a foundation mount configured to interface with a foundation structure; a first joist 129 coupled to the bottom inner panel 127; a second joist 130 laterally offset from the first joist 129; a flange coupled to the bottom inner panel 127 and configured to fasten to a second floor panel 126 via a series of clinch connections; a sill plate 141 coupled to and extending along a top edge of the first joist 129 to support a wall panel 101 and define a vertical wall panel 101 datum; a tie down 142 extending vertically through the sill plate 141 and configured to fasten to the wall panel; and a primary subfloor 143 arranged over the first joist 129 and the second joist 130 opposite the bottom inner panel 127, bridging the first and second joists 130 to support a finished flooring surface.

The panelized structure can further include a set of wall panels 101 each including: a left column element 102 configured to carry vertical loads through a left side of the wall panel 101 and defining a left gasket relief 103 extending vertically along the left column element 102; a right column element 104 configured to carry vertical loads through a right side of the wall panel; a footer element 105 extending between the left column element 102 and the right column element 104 and defining a lower vertical wall datum 106 configured to seat on a vertical floor datum 107 surface of a floor panel 126 to vertically locate the wall panel 101 relative to the floor panel 126; a header element 108 extending between the left column element 102 and the right column element 104 above the footer element; an insulative element 109 extending between the left column element 102, the right column element 104, the header element, and the footer element; a left flange no extending rearward from the left column element 102 opposite the exterior façade panel 120, laterally offset from the left gasket 113 relief, mating to a second right flange 117 of a second wall panel 101 installed adjacent the wall panel, via a series of clinch connections, and defining a left lateral wall datum 112 configured to laterally locate the first wall panel 101 relative to the second wall panel; and a left return 114 flange configured to stiffen the left flange no and extending laterally from the left flange no opposite the second wall panel.

Finally, the panelized structure includes a set of roof panels 152, each including: an inner panel defining a first inner panel edge configured to rest on the top plate 116 of first wall panel; a moisture barrier 115 extending across an exterior surface of the roof panels 152; a first joist 129 coupled to and extending below the inner panel and offset from a first edge of the inner panel; a second joist 130 coupled to and extending below the inner panel, laterally offset from the first joist 129, and offset from a second edge of inner panel opposite the first edge of the inner panel; a flange coupled to the inner panel, extending upwardly from the second edge of the inner panel and configured to fasten to a second roof panel 152 via a series of clinch connections.

In this example, the wall panels 101 and the roof panels 152 are assemblable via a set of joist brackets 136, each joist bracket 136 defining: a first surface coupled to the first joist 129 via a first series of fasteners; and a second surface coupled to the header of the first wall panel 101 via a second series of fasteners. The wall panels 101 and the floor panels 126 are assemblable via a series of fasteners 132 configured to: install within the first set of fastener bores 131 and the second set of fastener bores; and mate the lower vertical wall datum 106 of the first wall to the vertical floor datum 107 of the floor panel 126.

12. Decking

Figure 8:
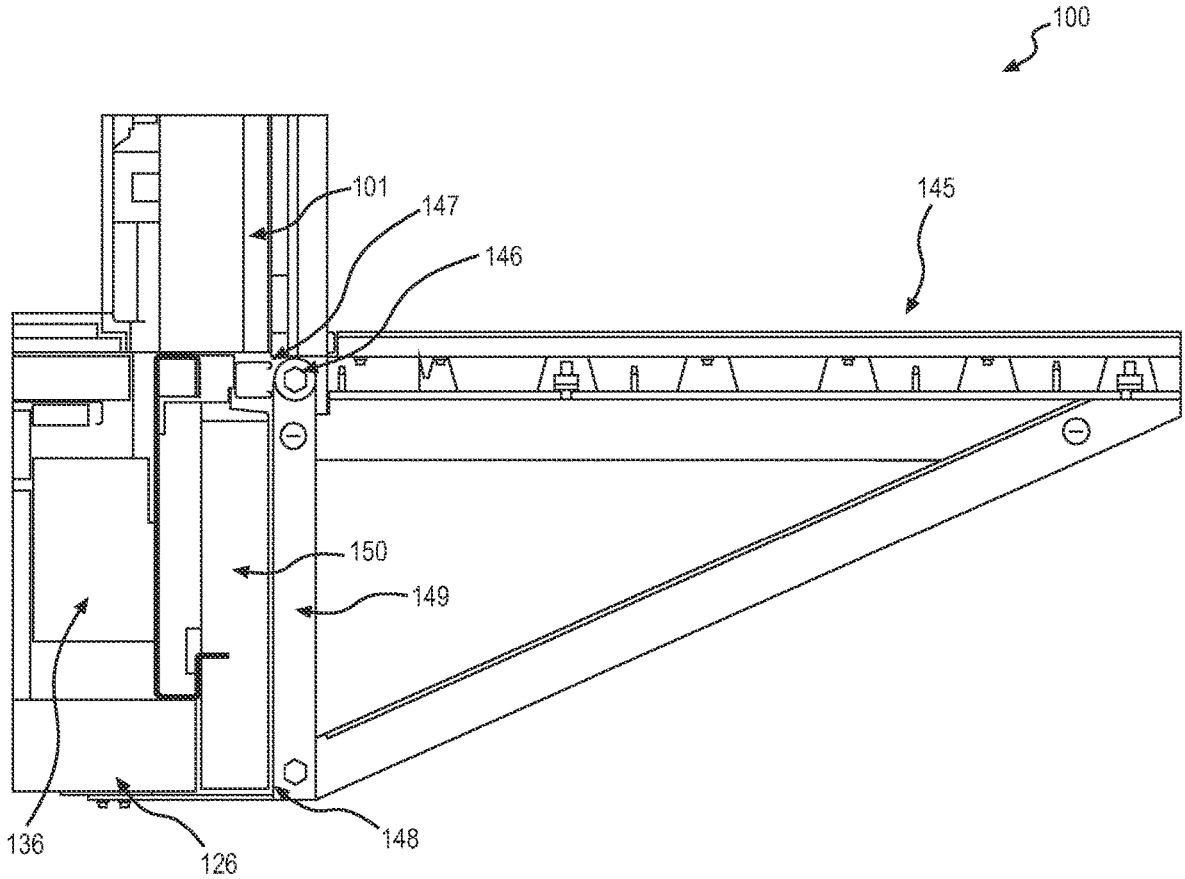
FIG. 8 is a representation of one variation of the panel system.

In one implementation, shown in FIG. 8, a panelized structure can include a cantilevered deck structure 145 mounted to a wall panel 101 and/or a floor panel 126 of the panelized structure.

For example, a foundation floor panel 137 can include an exterior mounting boss 147 extending along an outside surface of the first joist 129. The cantilevered deck structure 145 includes: an upper mounting extrusion 146 configured to couple to (e.g., press fit or fasten within) the exterior mounting boss 147 of the panelized structure. The deck structure 145 further includes: a lower support 148 additionally fastened to the panelized structure (e.g., at the floor panel 126) arranged below the upper mounting extrusion 146; a vertical strut 149 extending between the upper mounting extrusion 146 and the lower support 148 to distribute a weight of the deck structure 145 to the floor panel 126; and a horizontal surface extending from the upper mounting extrusion 146 and configured to support a deck (e.g., an outdoor surface including a set of natural or artificial decking panels).

14. Foundation

Figure 7:
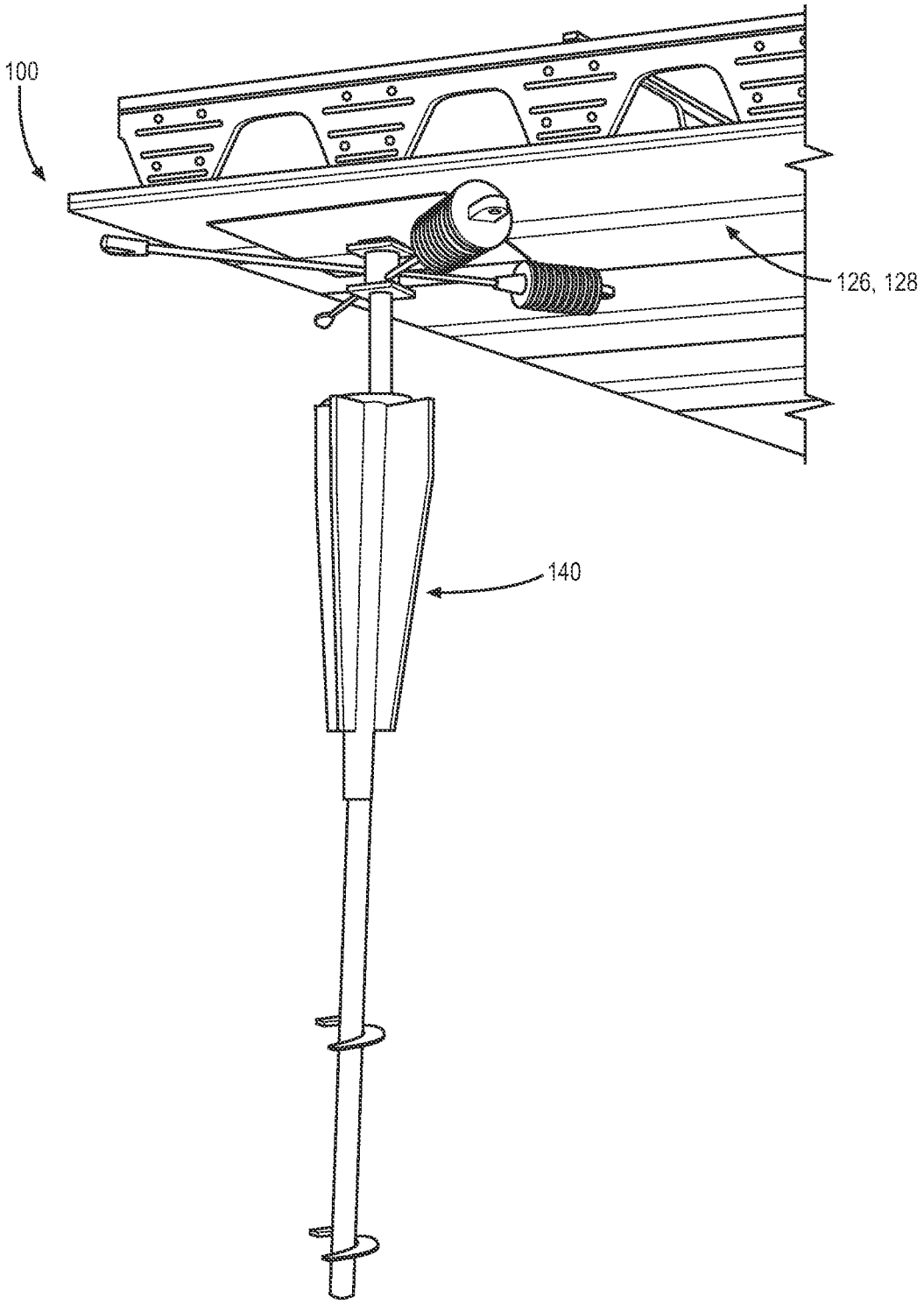
FIG. 7 is a representation of one variation of the panel system.

In one implementation, shown in FIG. 7, the prefabricated panelized structure mounts onto a foundation system including a set of piers as described in U.S. patent application Ser. No. 18/225,402.

For example, the foundation mount of the foundation floor panel 137 can include a thrust plate arranged on the bottom outer panel 128. The thrust plate mates (e.g., mounts to or otherwise couples to) with a thrust bearing of a foundation pier 140 to transfer a vertical load of the structure onto the foundation pier 140 via the thrust bearing. The foundation system includes: a set of foundation piers 140 (e.g., 8, 16, 24 etc.) distributed to evenly support the weight of the panelized structure.

In one implementation, a foundation pier 140 is configured to support a bottom surface of a panelized structure. The foundation pier 140 defines: a distal end configured to install below a terrestrial frost line; and a proximal end (e.g., proximal the panelized structure) configured to extend above the terrestrial frost line.

In one implementation, the foundation system is configured to balance forces on the panelized structure to reduce damage of the panelized structure during a seismic event (e.g., an earthquake). The foundation system includes, for each foundation pier 140: a collar arranged on the proximal end of the pier defining a first cable guide extending along a first horizonal axis, and defining a second cable guide extending along a second horizonal axis orthogonal to the first horizontal axis; the thrust bearing arranged on the pier opposite the collar; a first cable defining a first end coupled to the bottom surface of the structure, extending along the first horizonal axis, passing through the first cable guide, and defining a second end opposite the first end; a second cable defining a third end coupled to the bottom surface of the structure, extending along the second horizonal axis, passing through the second cable guide, and defining a fourth end opposite the third end; a first spring assembly coupled to the bottom surface of the structure and to the second end of the first cable and tensioning the first cable along the first horizontal axis to resist motion of the structure along the second horizontal axis; and a second spring assembly coupled to the bottom surface of the structure and to the fourth end of the second cable and tensioning the second cable along the second horizontal axis to resist motion of the structure along the first horizontal axis.

As a person skilled in the art will recognize from the previous detailed description and from the figures and claims, modifications and changes can be made to the embodiments of the invention without departing from the scope of this invention as defined in the following claims.

We claim:

1. A panel system comprising:

a foundation floor panel comprising:
- a bottom inner panel;
- an insulation layer arranged below the bottom inner panel;
- a bottom outer panel defining a foundation mount configured to interface with a foundation structure;
- a first joist coupled to the bottom inner panel;
- a second joist:
  - laterally offset from the first joist; and
  - coupled to the bottom inner panel;
- a foundation mount blocking:
  - bridging the first joist and the second joist;
  - arranged over the foundation mount; and
  - transferring forces between the foundation structure, the bottom outer panel, the insulation layer, the bottom inner panel, the first joist and the second joist;
- a flange:
  - coupled to the bottom inner panel;
  - extending upwardly from a second edge of the bottom inner panel; and
  - configured to fasten to a second floor panel via a series of clinch connections;
- a sill plate:
  - coupled to and extending along a top edge of the first joist;
  - configured to support a wall panel; and
  - defining a vertical floor datum;
- a tie down:
  - coupled to the first joist;
  - extending vertically through the sill plate; and
  - configured to fasten to the wall panel; and
- a primary subfloor:
  - arranged over the first joist and the second joist opposite the bottom inner panel;
  - bridging the first and second joists; and
  - configured to support a finished flooring surface.

2. The panel system of claim 1:

further comprising a floating floor panel comprising:
- a second bottom inner panel;
- a second insulation layer arranged below the second bottom inner panel;
- a second bottom outer panel;
- a third joist coupled to the second bottom inner panel;
- a fourth joist:
  - laterally offset from the third joist; and
  - coupled to the second bottom inner panel;
- a second flange:
  - coupled to the second bottom inner panel;
  - extending upwardly from a third edge of the second bottom inner panel; and
  - configured to fasten to the foundation floor panel via the series of clinch connections;
- a second primary subfloor:
  - arranged over the third joist and the fourth joist opposite the second bottom inner panel;
  - bridging the third joist and the fourth joist; and
  - configured to support the finished flooring surface; and wherein the foundation floor panel and the floating floor panel are assemblable into a section of a floor via the series of clinch connections:
- arranged along the flange of the foundation floor panel and the second flange of the floating floor panel; and
- configured to form an interlock securing the flange of the foundation floor panel to the second flange of the floating floor panel.

3. The panel system of claim 2, further comprising a secondary subfloor panel:
- bridging the second joist of the foundation floor panel and the third joist of the floor panel;
- abutting the primary subfloor of the foundation floor panel and the second primary subfloor of the floating floor panel; and
- configured to removably nest over the flange of the foundation floor panel and the second flange of the floating floor panel for installation of the series of clinch connections.

4. The panel system of claim 2, further comprising a moisture barrier flap:
- arranged on the bottom outer panel of the first floor panel; and
- configured to overlap a junction between the first floor panel and the second floor panel to prevent ingress of moisture.

5. The panel system of claim 2:

wherein the foundation floor panel further comprises a gasket relief:
- extending along an edge of the foundation floor panel between the bottom inner panel and the bottom outer panel; and further comprising a gasket:
- located along the gasket relief; and
- configured to compress between the gasket relief of foundation floor panel and a second edge of the floating floor panel during installation of the series of clinch connections.

6. The panel system of claim 1:

further comprising a prefinished outer footing panel:
- bonded to:
  - an exterior surface the footer element of the wall panel; and
  - an exterior edge of a floor panel;
- insulating a junction between the wall panel and the floor panel; and
- defining a prefinished outer surface.

7. The panel system of claim 1:

wherein the foundation floor panel further comprises:
- an exterior mounting boss extending along outside of first joist;

further comprising cantilevered deck structure comprising:
- an upper mounting extrusion:
  - configured to couple to the exterior mounting boss;
- a lower support:
  - arranged below the upper mounting extrusion; and
  - fastened to the foundation floor panel;

a vertical strut:
extending between the upper mounting extrusion and the lower support;
a horizontal surface:
extending from the upper mounting extrusion; and supporting a deck surface.

8. The panel system of claim 1, further comprising a rim joist:
extending perpendicular to first joist and second joist;
coupled to:
the first joist via a first joist bracket;
the second joist via a second joist bracket; and
configured to support a wall panel arranged perpendicular to the first joist.

9. The panel system of claim 1:
wherein the first joist and the second joist comprise sheet steel;
wherein the sill plate comprises a fiberglass extrusion; and
wherein the insulation layer comprises closed cell foam.

10. The panel system of claim 1:
further comprising a wall panel comprising:
a left column element:
configured to carry vertical loads through a left side of the wall panel; and
a right column element:
configured to carry vertical loads through a right side of the wall panel;
a footer element:
extending between the left column element and the right column element; and
comprising a lower flange defining a lower vertical wall datum configured to seat on a vertical floor datum surface of a floor panel to vertically locate the wall panel relative to the floor panel;
an insulative element:
extending between the left column element, the right column element, and the footer element; and
wherein the first wall panel and the floor panel are assemblable via a series of fasteners configured to:
install within the first set of fastener bores and the second set of fastener bores; and
mate the lower vertical wall datum of the first wall to the vertical floor datum of the floor panel.

11. The panel system of claim 10:
further comprising a roof panel comprising:
an inner panel:
defining a first inner panel edge configured to rest on the top plate of first wall panel;
an insulation layer extending above the inner panel;
a moisture barrier:
arranged above the insulation layer; and
extending across an exterior surface of the roof panel;
a first joist:
coupled to and extending below the inner panel; and offset from a first edge of the inner panel;
a second joist:
coupled to and extending below the inner panel;
laterally offset from the first joist; and
offset from a second edge of inner panel opposite the first edge of the inner panel;
a ceiling surface:
coupled to a first lower surface of the first joist and a second lower surface of the second joist;
wherein the roof panel is assemblable to the wall panel via a joist bracket:
defining a first surface coupled to the first joist via a first series of fasteners; and
defining a second surface coupled to the header of the first wall panel via a second series of fasteners.

12. The panel system of claim 1:
further comprising a wall panel, in a set of wall panels, comprising:
a left column element:
configured to carry vertical loads through a left side of the wall panel; and
defining a left gasket relief extending vertically along the left column element;
a right column element:
configured to carry vertical loads through a right side of the wall panel;
a footer element:
extending between the left column element and the right column element; and
defining a lower vertical wall datum configured to seat on a vertical floor datum surface of a floor panel to vertically locate the wall panel relative to the floor panel;
a header element:
extending between the left column element and the right column element above the footer element;
an insulative element:
extending between the left column element, the right column element, the header element, and the footer element;
a lower flange extending rearward from the footer element defining:
a lower vertical wall datum configured to seat against a floor datum of the floor panel to locate the wall panel relative to the floor panel; and
a tie down bore;
wherein the tie down of the floor panel installs within the tie down bore of the wall panel to mate the lower vertical wall datum of the wall panel to the vertical floor datum of the foundation floor panel.

13. The panel system of claim 1:
wherein the foundation mount of the foundation floor panel comprises:
a thrust plate arranged on the bottom outer panel configured to:
mate with a thrust bearing of a pier foundation; and
transfer a vertical load of the structure onto a foundation pier via the thrust bearing;
further comprising a foundation pier comprising:
a first pier:
configured to support a bottom surface of a structure; and
comprising:
a distal end configured to install below a terrestrial frost line; and
a proximal end configured to extend above the terrestrial frost line;
a collar:
arranged on the proximal end of the first pier;
defining a first cable guide extending along a first horizonal axis; and
defining a second cable guide extending along a second horizonal axis orthogonal to the first horizontal axis;

the thrust bearing arranged on the collar opposite the first pier;

a first cable:

defining a first end coupled to the bottom surface of the structure;

extending along the first horizonal axis;

passing through the first cable guide; and defining a second end opposite the first end;

a second cable:

defining a third end coupled to the bottom surface of the structure;

extending along the second horizonal axis;

passing through the second cable guide; and defining a fourth end opposite the third end;

a first spring assembly:

coupled to the bottom surface of the structure and to the second end of the first cable; and configured to tension the first cable along the first horizontal axis to resist motion of the structure along the second horizontal axis; and a second spring assembly:

coupled to the bottom surface of the structure and to the fourth end of the second cable; and configured to tension the second cable along the second horizontal axis to resist motion of the structure along the first horizontal axis.

14. A panel system comprising:

a roof panel comprising:

an inner panel:

defining a first inner panel edge configured to rest on a top plate of first wall panel;

an insulation layer extending above the inner panel;

a moisture barrier:

arranged above the insulation layer; and extending across an exterior surface of the roof panel;

a first joist:

coupled to and extending below the inner panel; and offset from a first edge of the inner panel;

a second joist:

coupled to and extending below the inner panel;

laterally offset from the first joist; and offset from a second edge of inner panel opposite the first edge of the inner panel;

a flange:

coupled to the inner panel;

extending upwardly from the second edge of the inner panel; and configured to fasten to a second roof panel via a series of clinch connections; and a gutter mount:

extending outwardly from the first edge of the roof panel; and configured to locate a gutter over the top plate of the first wall panel.

15. The panel system of claim 14:

further comprising a second roof panel comprising:

a second inner panel:

defining a second inner panel edge configured to rest on a top plate of a wall panel;

a second insulation layer extending above the inner panel;

a second moisture barrier:

arranged above the second insulation layer; and extending across a second exterior surface of the second roof panel;

a third joist:

coupled to and extending below the second inner panel; and offset from a second inner panel edge of the second inner panel;

a fourth joist:

coupled to and extending below the second inner panel;

laterally offset from the third joist; and offset from a third edge of inner panel opposite the second inner panel edge;

a second flange:

coupled to the second inner panel;

extending the second inner panel edge; and configured to fasten to the first roof panel via a series of clinch connections; and a second gutter mount:

extending outwardly from an outer panel edge of the roof panel; and cooperating with the gutter mount to support a gutter at a target angle for water flow, wherein the roof panel and the second roof panel are assemblable into planar horizontal non-sloped roof surface via the series of clinch connections:

arranged along the flange of the roof panel and the second flange of the second roof panel; and configured to form an interlock securing the flange to the second flange.

16. The panel system of claim 15, further comprising a moisture barrier flap configured to overlap a junction between the roof panel and the second roof panel to prevent ingress of moisture.

17. The panel system of claim 15:

wherein the roof panel further comprises a gasket relief:

extending along an edge of the roof panel; and further comprising a gasket:

located along the gasket relief; and configured to compress between the gasket relief of the roof panel and the second edge a second roof during installation of the series of clinch connections.

18. The panel system of claim 14, wherein the roof panel further comprises a blocking:

extending between the first joist and the second joist; and configured to prevent rolling of the first joist and the second joist.

19. The panel system of claim 14:

further comprising a prefinished outer panel:

bonded to:

an exterior surface the header element of the wall panel; and an exterior edge of a roof panel;

insulating a junction between the wall panel and the roof panel; and defining a prefinished outer surface.

20. A structure comprising:

a floor panel comprising:

a bottom inner panel;

an insulation layer arranged below the bottom inner panel;

a bottom outer panel defining a foundation mount configured to interface with a foundation structure;

a first joist coupled to the bottom inner panel;

a second joist:

laterally offset from the first joist; and coupled to the bottom inner panel;

a flange:
coupled to the bottom inner panel;
extending upwardly from a second edge of the bottom inner panel; and
configured to fasten to a second floor panel via a series of clinch connections;
a sill plate:
coupled to and extending along a top edge of the first joist;
configured to support a wall panel; and
defining a vertical wall panel datum;
a tie down:
coupled to the first joist;
extending vertically through the sill plate; and
configured to fasten to the wall panel; and
a primary subfloor:
arranged over the first joist and the second joist opposite the bottom inner panel;
bridging the first and second joists; and
configured to support a finished flooring surface; and
a wall panel, in a set of wall panels, comprising:
a left column element:
configured to carry vertical loads through a left side of the wall panel; and
defining a left gasket relief extending vertically along the left column element;
a right column element:
configured to carry vertical loads through a right side of the wall panel;
a footer element:
extending between the left column element and the right column element; and
defining a lower vertical wall datum configured to seat on a vertical floor datum surface of a floor panel to vertically locate the wall panel relative to the floor panel;
a header element:
extending between the left column element and the right column element above the footer element;
an insulative element:
extending between the left column element, the right column element, the header element, and the footer element;
a left clinch flange:
extending rearward from the left column element opposite the exterior façade panel;
laterally offset from the left gasket relief;
configured to mate to a second right clinch flange of a second wall panel installed adjacent the wall panel, via a series of clinch connections; and
defining a left lateral wall datum configured to laterally locate the first wall panel relative to the second wall panel; and
a left return flange:
configured to stiffen the left clinch flange; and
extending laterally from the left clinch flange opposite the second wall panel; and
a roof panel comprising:
an inner panel:
defining a first inner panel edge configured to rest on the top plate of first wall panel;
a moisture barrier:
extending across an exterior surface of the roof panel;
a first joist:
coupled to and extending below the inner panel; and
offset from a first edge of the inner panel;
a second joist:
coupled to and extending below the inner panel;
laterally offset from the first joist; and
offset from a second edge of inner panel opposite the first edge of the inner panel;
a flange:
coupled to the inner panel;
extending upwardly from the second edge of the inner panel; and
configured to fasten to a second roof panel via a series of clinch connections;
wherein wall panel and the roof panel are assemblable via
a joist bracket:
defining a first surface coupled to the first joist via a first series of fasteners; and
defining a second surface coupled to the header of the first wall panel via a second series of fasteners; and
wherein the first wall panel and the floor panel are assemblable via a series of fasteners configured to:
install within the first set of fastener bores and the second set of fastener bores; and
mate the lower vertical wall datum of the first wall to the vertical floor datum of the floor panel.

* * * * *